US010398956B2

(12) United States Patent
Remaklus et al.

(10) Patent No.: US 10,398,956 B2
(45) Date of Patent: Sep. 3, 2019

(54) MOUNTING SYSTEMS AND METHODS FOR SPORTS EQUIPMENT

(71) Applicant: LOCKED IN SPORTS LLC, Bellingham, WA (US)

(72) Inventors: Justin Scott Remaklus, Ferndale, WA (US); Jacob Cooper Locker, Ferndale, WA (US); Aaron John Dickson, Lynden, WA (US); Lucas Grant Berendsen, Bellingham, WA (US)

(73) Assignee: LOCKED IN SPORTS LLC, Bellingham, WA (US)

( * ) Notice: Subject to any disclaimer, the term of this patent is extended or adjusted under 35 U.S.C. 154(b) by 19 days.

(21) Appl. No.: 15/620,575

(22) Filed: Jun. 12, 2017

(65) Prior Publication Data

US 2018/0207502 A1 Jul. 26, 2018

Related U.S. Application Data

(60) Provisional application No. 62/478,039, filed on Mar. 29, 2017, provisional application No. 62/476,725, filed on Mar. 25, 2017, provisional application No. 62/467,096, filed on Mar. 4, 2017, provisional application No. 62/466,400, filed on Mar. 3, 2017, (Continued)

(51) Int. Cl.

| | |
|---|---|
| ***A63B 63/08*** | (2006.01) |
| ***A63B 63/00*** | (2006.01) |
| ***A63B 17/04*** | (2006.01) |
| ***A63B 71/02*** | (2006.01) |

(52) U.S. Cl.

CPC ..... *A63B 63/083* (2013.01); *A63B 17/04* (2013.01); *A63B 63/00* (2013.01); *A63B 71/023* (2013.01); *A63B 2063/002* (2013.01)

(58) Field of Classification Search

CPC ..... A63B 63/083; A63B 63/08; A63B 63/00; E04G 3/00; G09F 15/00; F16L 3/10

See application file for complete search history.

(56) References Cited

U.S. PATENT DOCUMENTS 3,392,980 A 7/1968 Ortega
4,040,624 A 8/1977 Lee
(Continued)

FOREIGN PATENT DOCUMENTS

WO 2018140511 A1 8/2018

OTHER PUBLICATIONS

International Searching Authority, ISR & Written Opinion, PCT/US2018/015069, dated Apr. 12, 2018, 8 pages.

*Primary Examiner* — Eugene L Kim
*Assistant Examiner* — Christopher Glenn
(74) *Attorney, Agent, or Firm* — Michael R. Schacht; Schacht Law Office, Inc.

(57) ABSTRACT

A mounting system for mounting a plurality of sport devices to a plurality of structures comprising a device attachment system and a structure attachment system. The device attachment system comprises a plurality of distal portions and a plurality of proximal portions. The structure attachment system attaches one of the proximal portions to each of the structures. Each of the distal portions is attached to one of the sport devices. Each of the distal portions is detachably attachable to each of the proximal portions to allow each of the sport devices to be detachably attached to each of the plurality of structures.

12 Claims, 33 Drawing Sheets

Related U.S. Application Data provisional application No. 62/464,455, filed on Feb. 28, 2017, provisional application No. 62/449,910, filed on Jan. 24, 2017.

(56) References Cited

U.S. PATENT DOCUMENTS

| | | | | | |
|---|---|---|---|---|---|
| 4,395,040 | A | | 7/1983 | White | |
| 5,022,649 | A | | 6/1991 | Traub et al. | |
| 5,088,672 | A | * | 2/1992 | Neuendorf | F16B 2/06 248/218.4 |
| 5,240,258 | A | | 8/1993 | Bateman | |
| 5,277,432 | A | | 1/1994 | Bateman | |
| 5,279,496 | A | | 1/1994 | Schroeder | |
| 5,342,062 | A | | 8/1994 | Lance | |
| 5,346,226 | A | | 9/1994 | Block | |
| 5,570,880 | A | * | 11/1996 | Nordgran | A63B 63/083 248/218.4 |
| 5,816,955 | A | * | 10/1998 | Nordgran | A63B 63/083 473/486 |
| 5,893,807 | A | * | 4/1999 | Aikens | A63B 63/00 473/422 |
| 6,056,654 | A | | 5/2000 | Schroeder | |
| 6,808,177 | B2 | | 10/2004 | Dehart | |
| 7,331,882 | B1 | * | 2/2008 | White | A63B 63/083 473/479 |
| 7,845,646 | B1 | | 12/2010 | Weber | |
| 8,172,231 | B2 | | 5/2012 | Massier | |
| 8,403,329 | B2 | | 3/2013 | Krickovic | |
| 8,534,672 | B2 | | 9/2013 | Brune | |
| 8,708,294 | B2 | * | 4/2014 | Lam | F16M 11/10 248/292.14 |
| 8,724,037 | B1 | | 5/2014 | Massey | |
| 9,303,959 | B2 | | 4/2016 | Doria | |
| 9,545,552 | B1 | * | 1/2017 | Buchweitz | A63B 63/083 |
| 2002/0105477 | A1 | | 8/2002 | Bragg et al. | |
| 2006/0261226 | A1 | * | 11/2006 | Petrick | F16M 11/10 248/274.1 |
| 2007/0234616 | A1 | * | 10/2007 | Betham | G09F 15/00 40/607.03 |
| 2008/0023915 | A1 | | 1/2008 | Morrow et al. | |
| 2009/0163305 | A1 | * | 6/2009 | Connerley | A63B 63/083 473/481 |
| 2016/0258720 | A1 | | 9/2016 | Côté et al. | |
| 2017/0205207 | A1 | | 7/2017 | Anderson | |

* cited by examiner

MOUNTING SYSTEMS AND METHODS FOR SPORTS EQUIPMENT

RELATED APPLICATIONS

This application, U.S. patent application Ser. No. 15/620,575 filed Jun. 12, 2017, claims benefit of U.S. Provisional Application Ser. No. 62/478,039 filed Mar. 29, 2017.

This application, U.S. patent application Ser. No. 15/620,575 filed Jun. 12, 2017, also claims benefit of U.S. Provisional Application Ser. No. 62/476,725 filed Mar. 25, 2017.

This application, U.S. patent application Ser. No. 15/620,575 filed Jun. 12, 2017, also claims benefit of U.S. Provisional Application Ser. No. 62/467,096 filed Mar. 4, 2017.

This application, U.S. patent application Ser. No. 15/620,575 filed Jun. 12, 2017, also claims benefit of U.S. Provisional Application Ser. No. 62/466,400 filed Mar. 3, 2017.

This application, U.S. patent application Ser. No. 15/620,575 filed Jun. 12, 2017, also claims benefit of U.S. Provisional Application Ser. No. 62/464,455 filed Feb. 28, 2017.

This application, U.S. patent application Ser. No. 15/620,575 filed Jun. 12, 2017, also claims benefit of U.S. Provisional Application Ser. No. 62/449,910 filed Jan. 24, 2017.

The contents of all related applications are incorporated herein by reference.

TECHNICAL FIELD

The present invention relates to sports equipment and, in particular, to sports equipment that may easily be reconfigured to accommodate different sports activities.

BACKGROUND

Young athletes often participate in multiple sports. Different sports employ different balls and devices and require different skills. To develop skills for different sports, different activities and training equipment is often used. For example, a basketball hoop and backboard may be used for basketball training, a target may be used for baseball or football training, and a net may be used for soccer training. Further, sports training equipment is often created for use by older children and adults. Adapting sports training equipment for use by smaller children is often either difficult or impossible.

The need exists for sports equipment that can easily be reconfigured for different sporting activities and/or that facilitates the use of existing adult sports training equipment for smaller children.

SUMMARY

The present invention may be embodied as a mounting system for mounting a plurality of sport devices to a plurality of structures comprising a device attachment system and a structure attachment system. The device attachment system comprises a plurality of distal portions and a plurality of proximal portions. The structure attachment system attaches one of the proximal portions to each of the structures. Each of the distal portions is attached to one of the sport devices. Each of the distal portions is detachably attachable to each of the proximal portions to allow each of the sport devices to be detachably attached to each of the plurality of structures.

The present invention may also be embodied as a method of mounting a plurality of sport devices to a plurality of structures comprising the following steps. A proximal portion is attached to each of the structures. A distal portion is attached to each of the sport devices. Each of the distal portions is detachably attached to each of the proximal portions such that each of the sport devices is detachably attached to each of the plurality of structures.

The present invention may also be embodied as a mounting system for mounting a sport device to a structure comprising a device attachment system and a structure attachment system. The device attachment system comprising a frame and a mount. The frame defines at least one hook portion, where the frame is attached to the sport device. The mount defines at least one primary support flange. The structure attachment system attaches the mount to the structure. The frame is detachably attached to the mount to detachably attach the sport device to the structure.

DETAILED DESCRIPTION

Figure 1A:
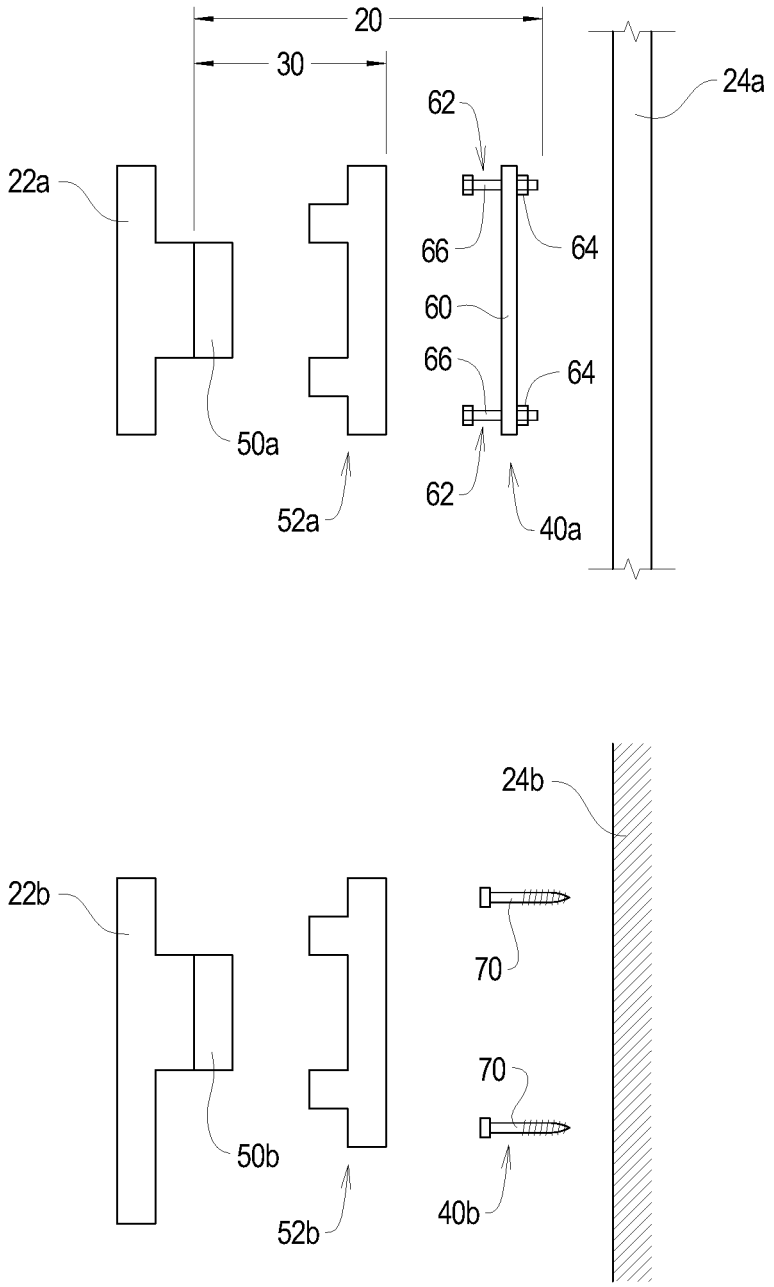
FIGS. 1A-1E are highly schematic views of various configurations of a first example mounting system for sports equipment of the present invention.
Figure 1B:
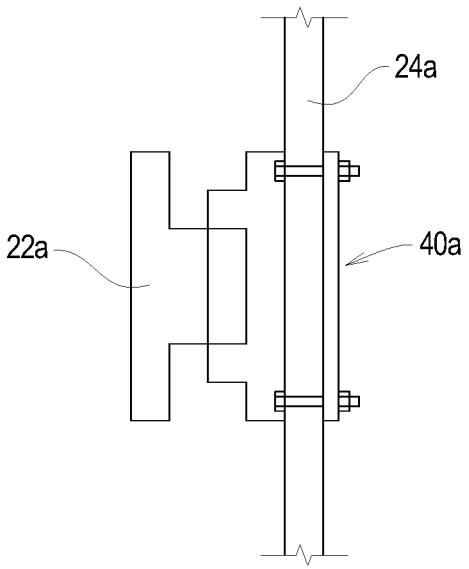
Figure 1C:
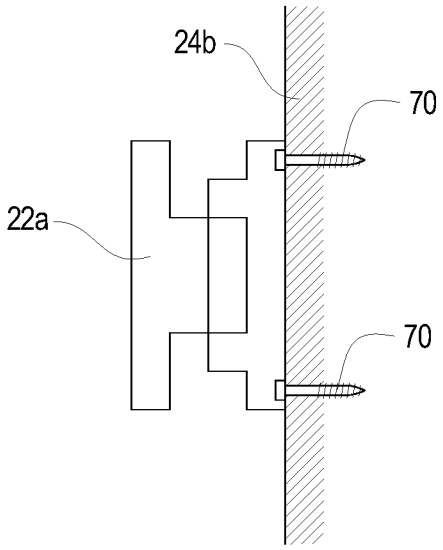
Figure 1D:
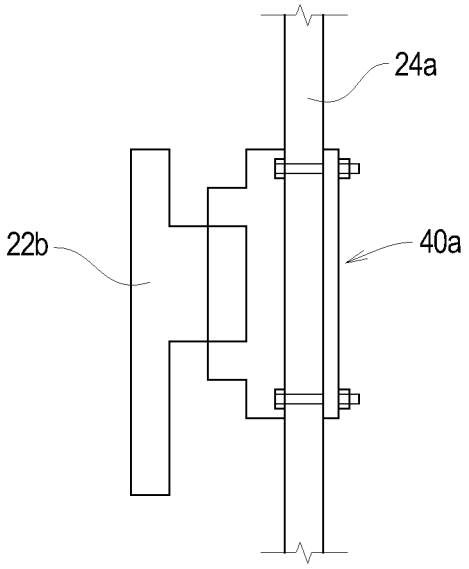

Referring initially to FIGS. 1A-1E of the drawing depicted therein is a schematic view of a first example sports mounting system 20 adapted to support one or more sport devices 22 to one or more structures 24. If multiple sport devices 22 are used, the sport devices 22 may be different from each other. And if multiple structures 24 are used, the structures 24 may also be different from each other.

Examples of the sport devices 22 include basketball backboard and hoop assemblies, football and/or baseball targets, soccer goals, and protective padding. Examples of structures 24 include poles, walls, and posts. The structures may be free-standing (e.g., poles) or form a part of a larger structure (walls and posts).

The first example sports mounting system 20 comprises a first example device attachment system 30 and one or more structure attachment systems 40. The first example device attachment system 30 comprises one or more distal portions 50 attached to the device(s) 22 and one or more proximal portions 52 attached to the structure(s) 24. Each distal portion 50 is adapted to be detachably attached to a proximal portion 52 to secure the device 22 relative to the structure 24.

The first example sports mounting system 20 depicted in FIG. 1 is adapted to support first and second devices 22*a* and 22*b* to first and second structures 24*a* and 24*b*. The example sports mounting system depicted in FIG. 1 comprises first and second structure attachment systems 40*a* and 40*b*, one for each of the structures 24*a* and 24*b*. The first example device attachment system 30 comprises first and second distal portions 50*a* and 50*b*, one connected to each of the first and second devices 22*a* and 22*b*, and first and second proximal portions 52*a* and 52*b*, one connected to each of the first and second attachment system 40*a* and 40*b*. In the first example device attachment system 30, the first and second distal portions 50*a* and 50*b* are identical, and the first and second proximal portions 52*a* and 52*b* are identical.

Figure 1E:
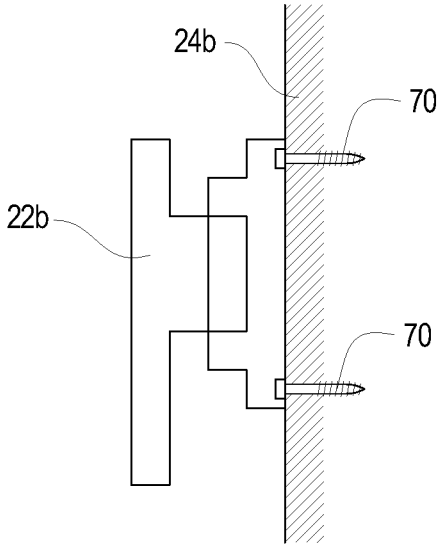
Figure 2B:
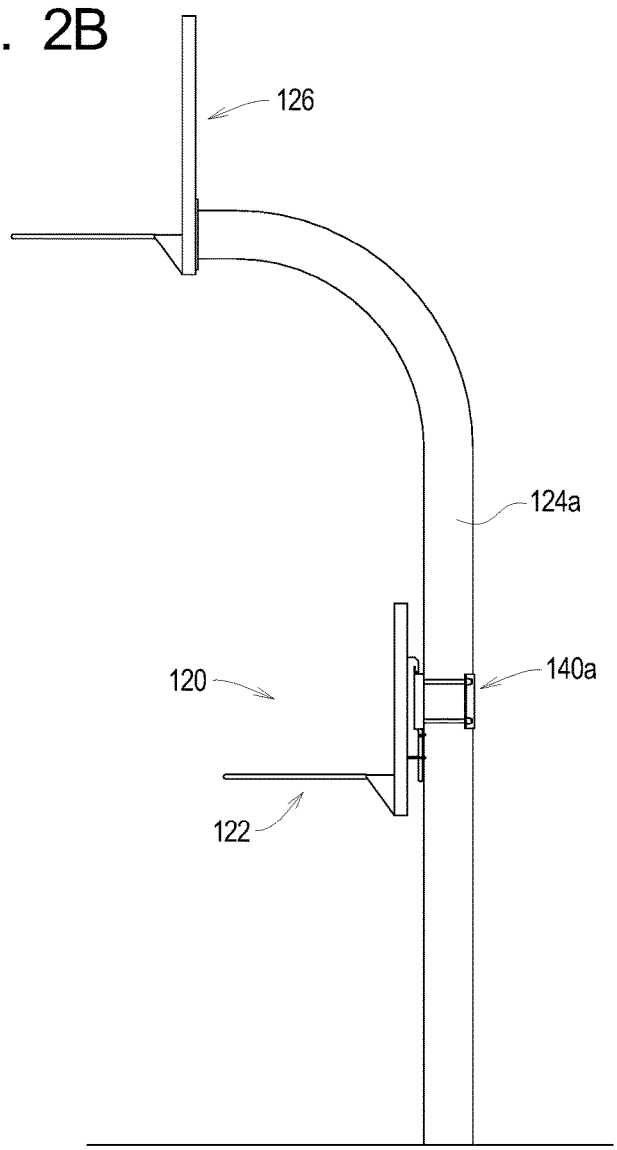
FIG. 2B is a side elevation view of the second example mounting system for sports equipment.
Figure 2A:
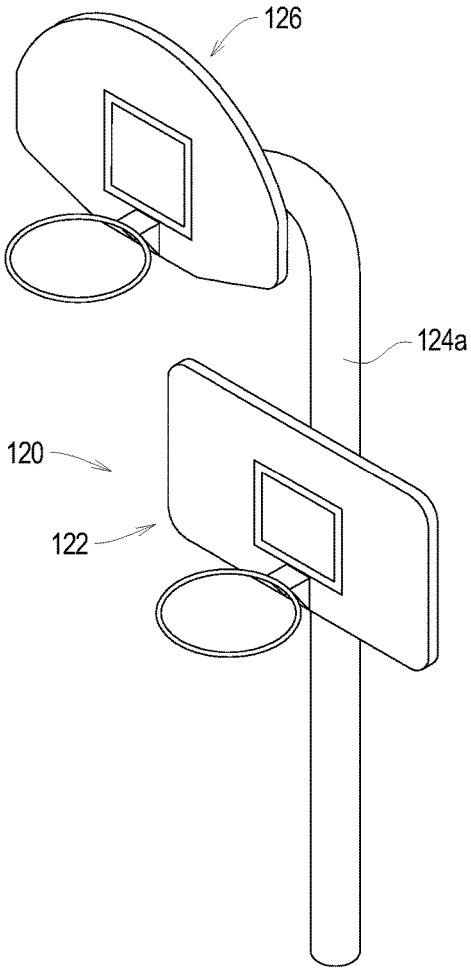
FIG. 2A is a perspective view of a second example mounting system for sports equipment of the present invention supporting a first example sport device assembly relative to a first example structure.
Figure 3:
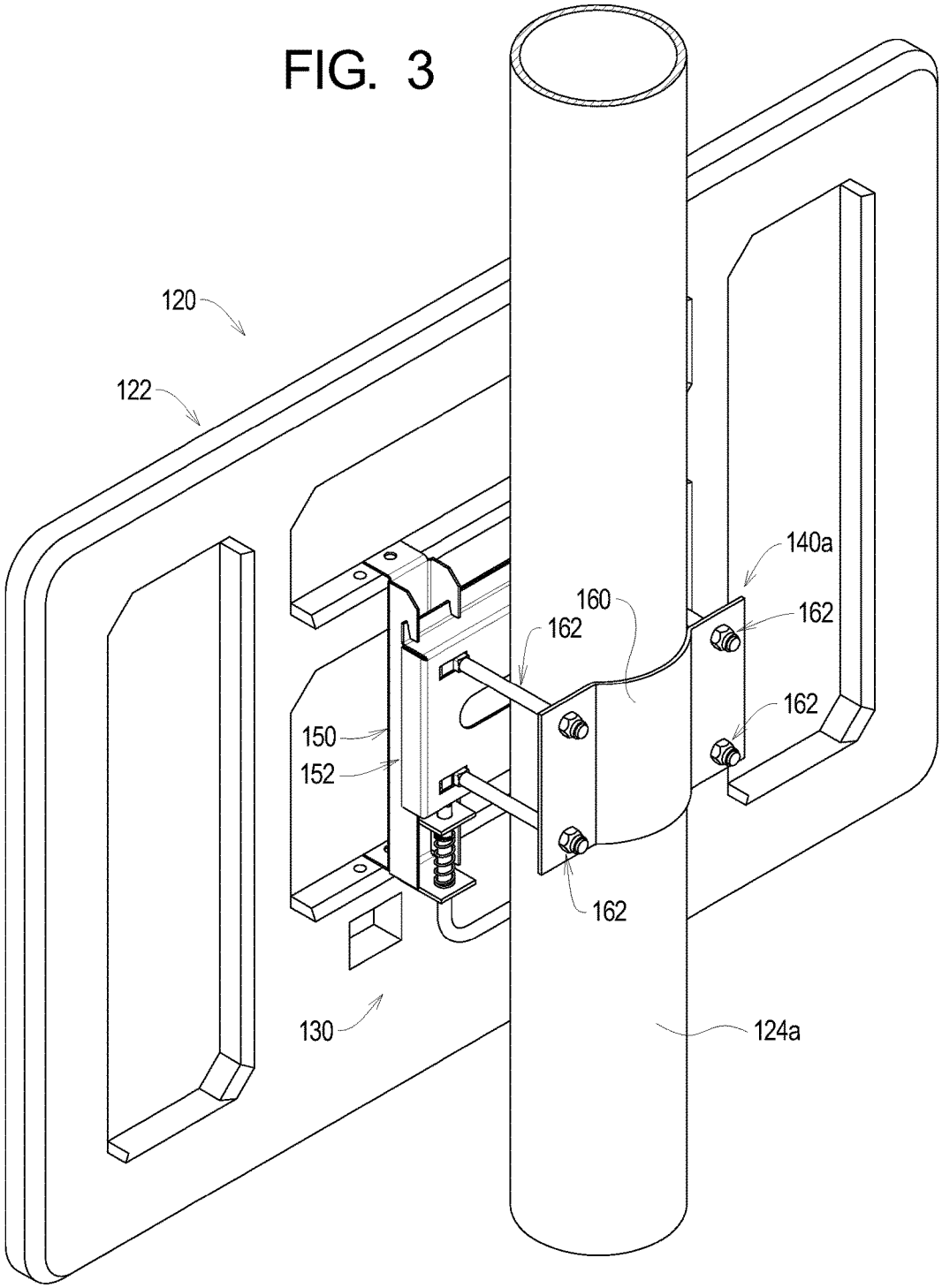
FIG. 3 is a rear perspective view of a first example device attachment system and a first example structure attachment system of the second example mounting system for sports equipment.
Figure 4:
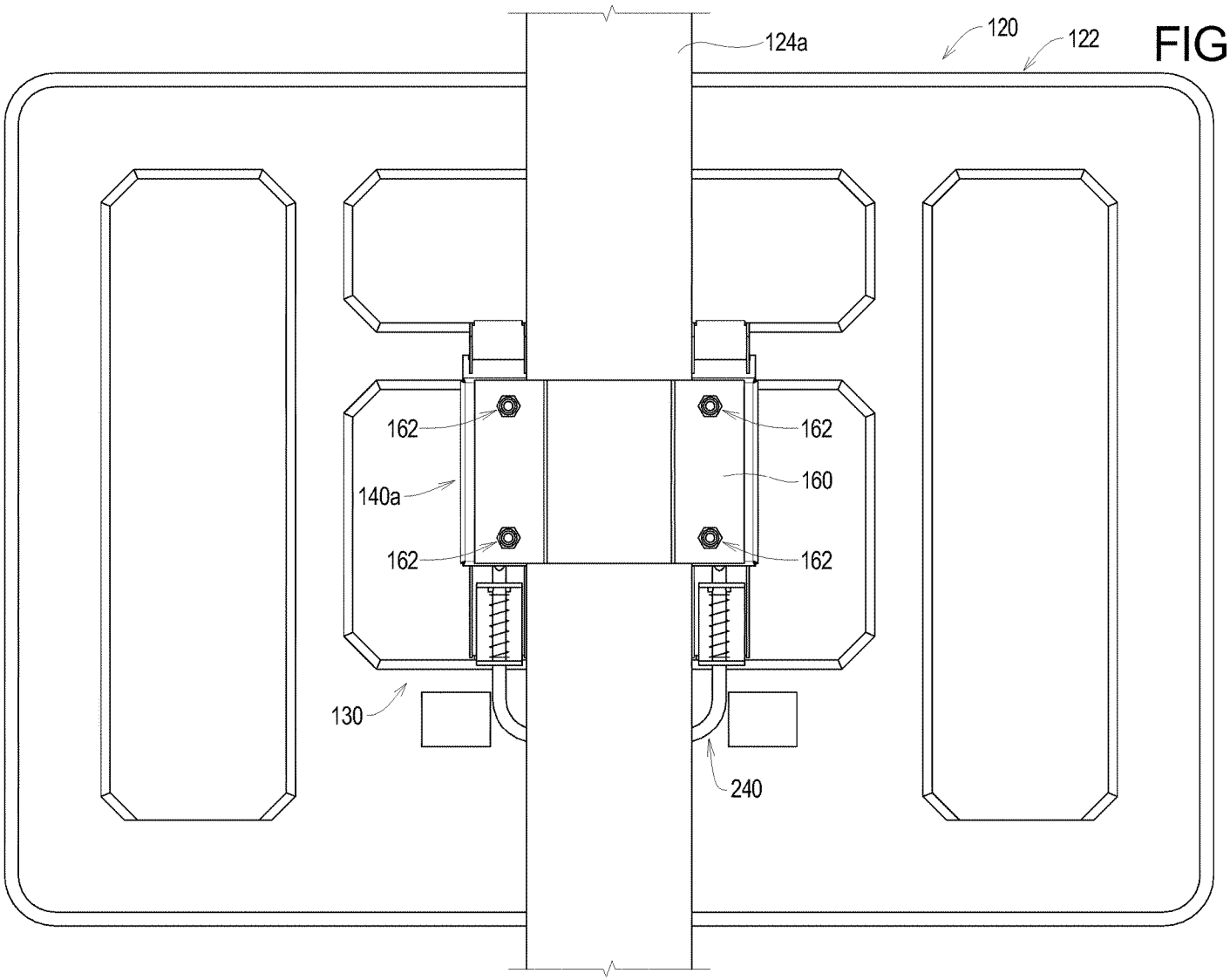
FIG. 4 is a rear elevation view of the first example device attachment system and the first example structure attachment system of the second example mounting system for sports equipment.
Figure 5:
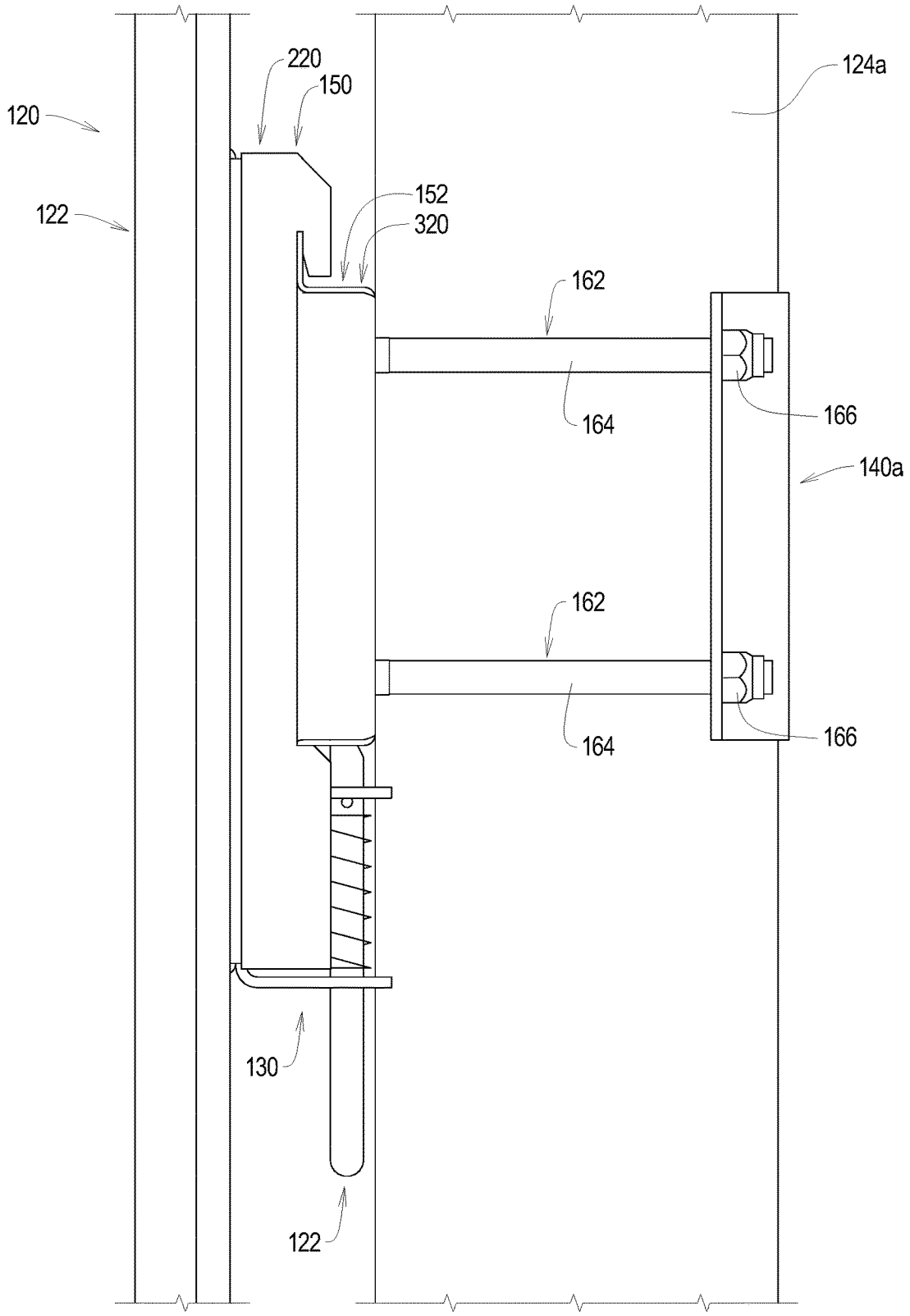
FIG. 5 is a side elevation view of the first example device attachment system and the first example structure attachment system of the second example mounting system for sports equipment.
Figure 6:
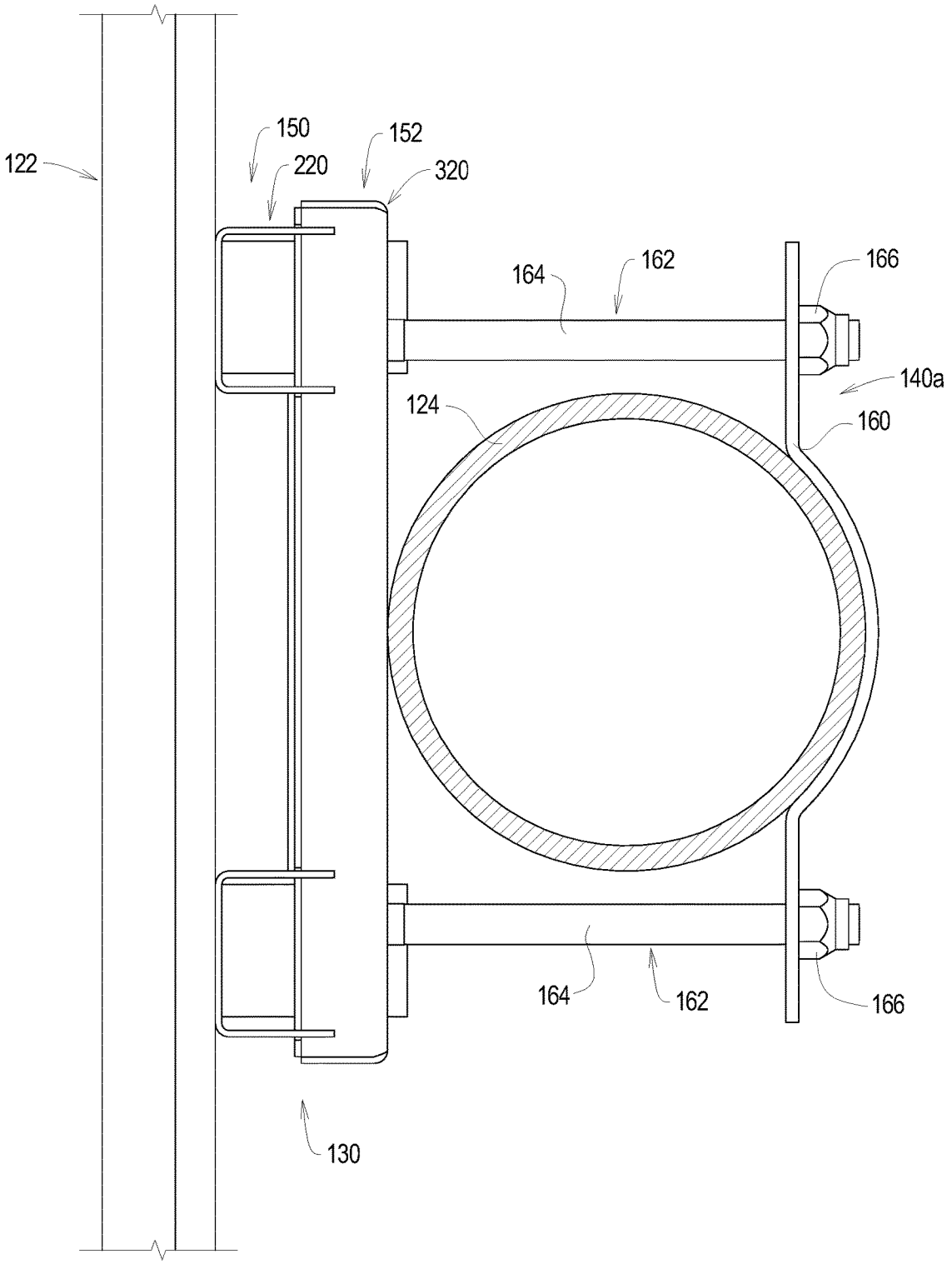
FIG. 6 is a top plan elevation view of the first example device attachment system and the first example structure attachment system of the second example mounting system for sports equipment.

The first example sports mounting system 20 operates in any one of four separate configurations: a first configuration in which the first device 22*a* is mounted to the first structure 24*a* (FIG. 1B); a second configuration in which the first device 22*a* is mounted to the second structure 24*b* (FIG. 1C); a third configuration in which the second device 22*b* is mounted to the first structure 24*a* (FIG. 1D); and a fourth configuration in which the second device 22*b* is mounted to the second structure 24*b* (FIG. 1E).

The example first structure 24*a* is an upright member such as a post or pole, and the first example structure attachment system 40*a* comprises a clamp plate 60 and a plurality of bolt assemblies 62 each comprising a nut 64 and a bolt 66. The upright member forming the first structure 24*a* is clamped between the proximal portion 52 of the device attachment system 30 and the clamp plate 60 using the bolt assemblies 62.

The example second structure 24*b* is a vertical such as a wall, and the second example structure attachment system 40*b* comprises a plurality of lag screws 70. The lag screws 70 are passed through the proximal portion 52 of the device attachment system 30 and threaded into a structural portion (e.g., studs, header) of the wall forming the second structure 24*b*.

The first example sports mounting system 20 thus allows multiple sport devices of different types to be used at multiple locations adjacent to structures of different types without the need to purchase multiple sport devices of the same type. The first example sports mounting system 20 further facilitates the use of the same structure to support multiple sport devices of different types. In addition, the first example sports mounting system 20 may be used with a single sport device, more than two sport devices, a single structure, more than two structures, a single distal portion, more than two distal portions, a single proximal portion, and/or more than two proximal portions.

Figure 14:
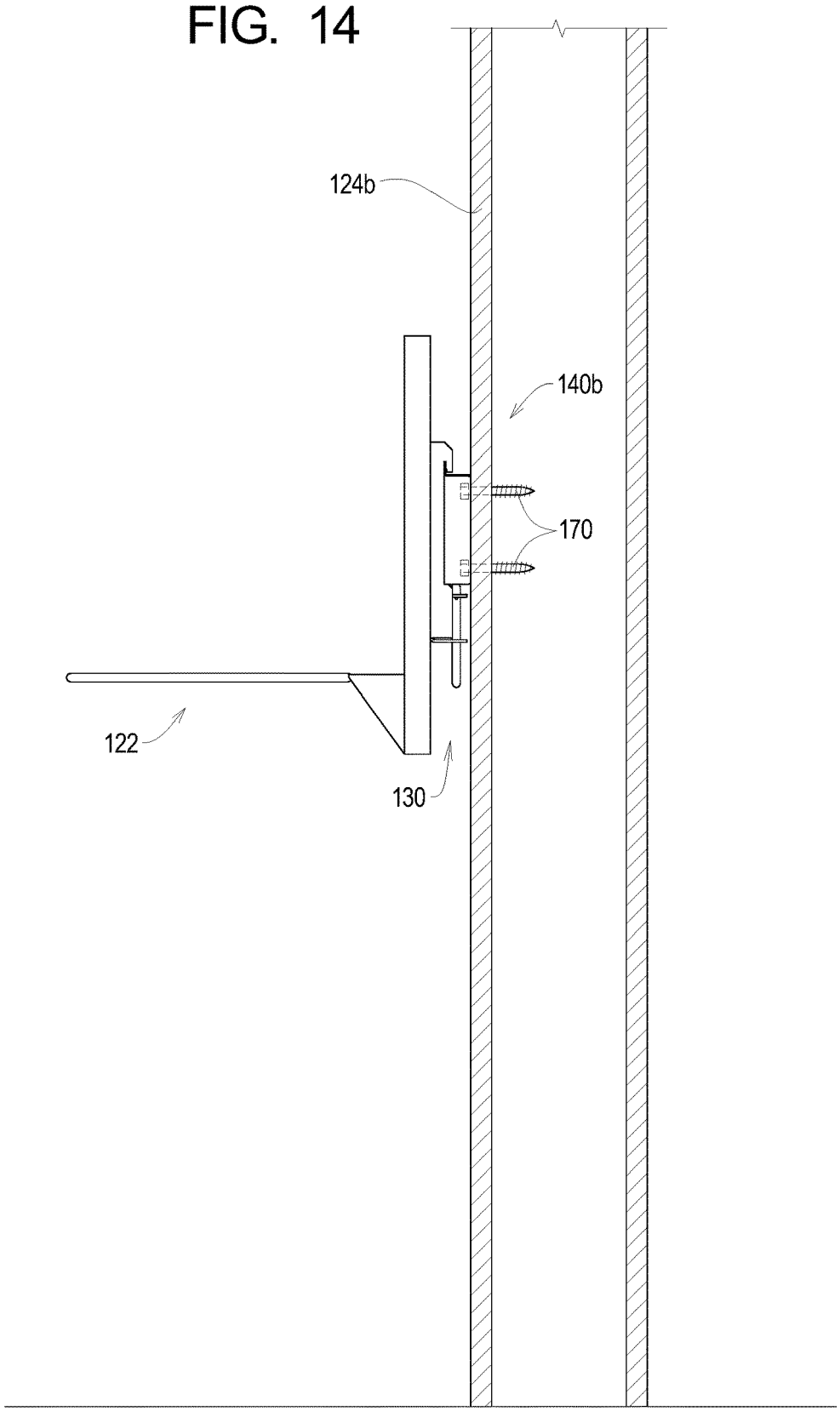
FIG. 14 is a side elevation view depicting a second example structure attachment system and a second example structure.
Figure 15:
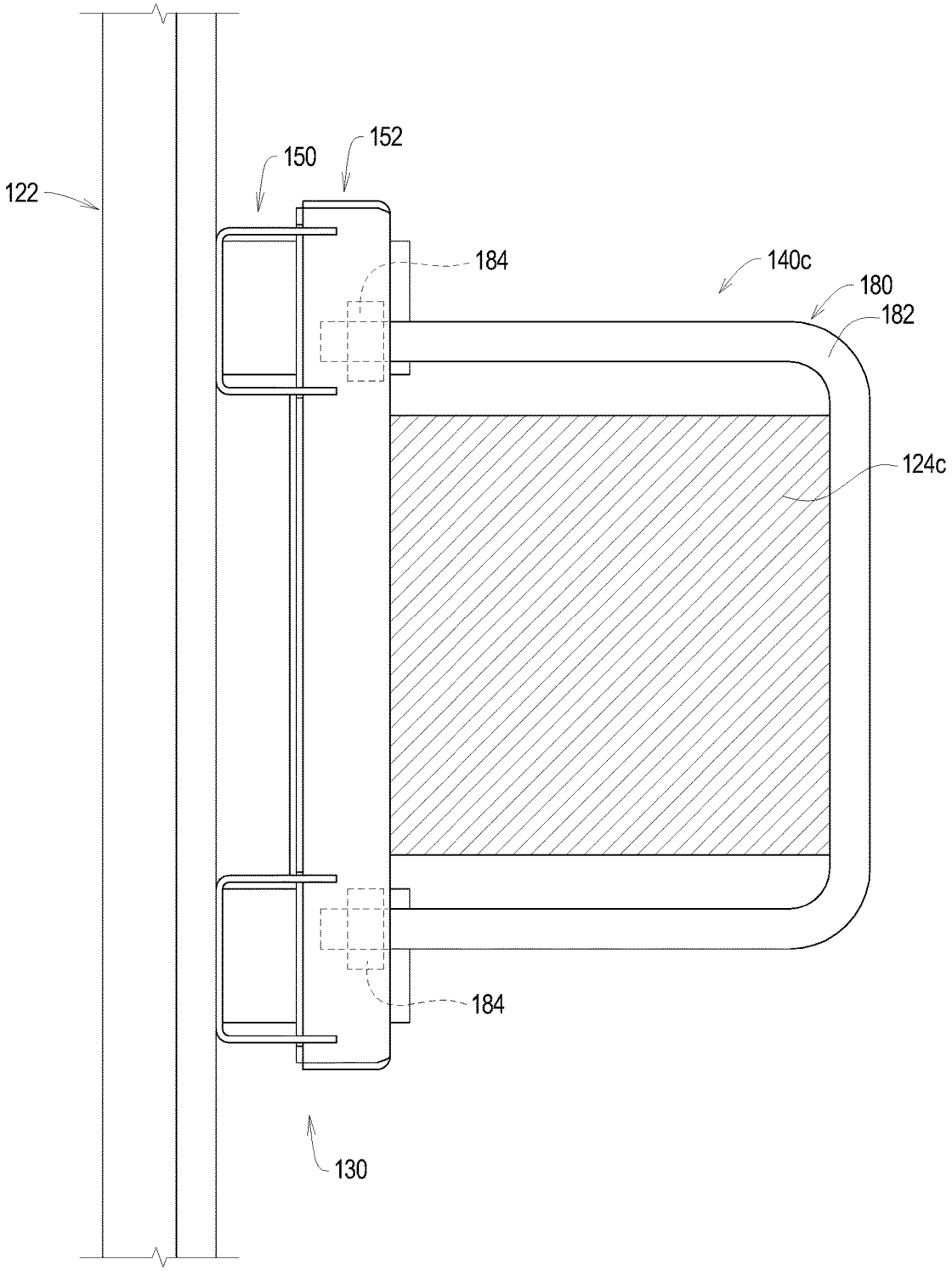
FIG. 15 is a top plan view depicting a third example structure attachment system and a third example structure.

Turning now to FIGS. 2A, 2B, and 3-15, depicted therein is a second example sports mounting system 120 constructed in accordance with, and embodying, the principles of the present invention. As shown in FIGS. 2A, 2B, and 3-13, the second example sports mounting system 120 supports a device 122 from a pole 124*a*. The pole 124*a* further supports a primary device 126. The example device 122 and primary device 126 are basketball goal assemblies comprising a backboard and a hoop. In this context, the device 122 may be referred to as a "secondary" device. The second example sports mounting system 120 may also be used to support the device 122 from a wall 124*b* as shown in FIG. 14 or a post as shown in FIG. 15.

The second example sports mounting system 120 comprises a second example device attachment system 130 and a plurality of structure attachment systems 140*a*, 140*b*, and 140*c*. The device attachment system 130 comprises a distal portion 150 and a proximal portion 152.

The first example structure attachment system 140*a* comprises a clamp plate 160 and a plurality of bolt assemblies 162. Each bolt assembly 162 comprises a bolt 164 and a nut 166. The example attachment system 140*a* comprise four of the bolt assemblies 162. The second example structure attachment system 140*b* comprises a plurality of lag screws 170. The third example structure attachment system 140*c* comprises at least one U-bolt assembly 180 comprising a U-bolt 182 and nuts 184.

Figure 7:
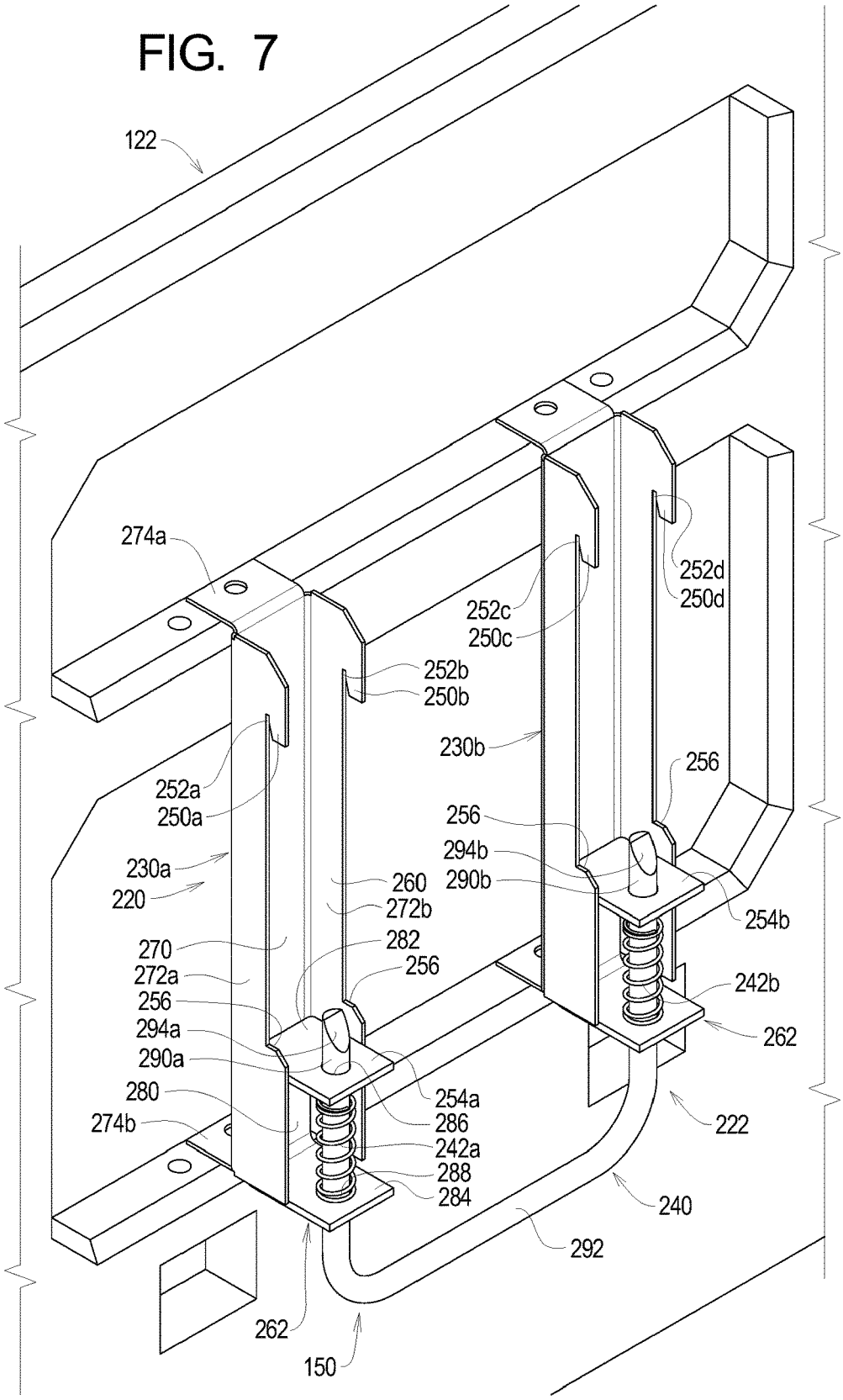
FIG. 7 is a perspective view of a first example distal portion of the first example device attachment system of the second example mounting system for sports equipment.

Turning now to FIG. 7 of the drawing, the example distal portion 150 of the second example device attachment system 130 will be described in further detail. The example distal portion 150 comprises a frame 220 and a latch assembly 222. The example frame 220 comprises at least one frame structure 230, with the example frame 220 comprising first and second frame structures 230*a* and 230*b*. The example latch assembly 222 comprises at least one latch member 240 and at least one biasing member 242. The example frame structures 230 each define a hook portion 250 defining a hook slot 252 and a main guide surface 254. The example frame structures 230 each further define at least one stop edge 256 arranged below each of the hook slots 252.

More specifically, the example frame structures 230 each comprise a frame member 260 and a guide member 262. The example frame members 260 each comprise a frame plate 270, first and second side flanges 272*a* and 272*b*, and first and second end tabs 274*a* and 274*b*. The example first and second side flanges 272*a* and 272*b* are substantially orthogonal to a plane defined by the frame plate 270. The example first and second end tabs 274*a* and 274*b* are substantially orthogonal to a plane defined by the frame plate 270 and to planes defined by the first and second side flanges 272*a* and 272*b*. During normal use of the frame members 260, the first and second side flanges 272*a* and 272*b* are substantially vertical, while the first and second end tabs 274*a* and 274*b* are substantially horizontal. The first and hook portions 250 are formed in the side flanges 272*a* and 272*b* and, during normal use, the hook slots 252 are substantially vertical with an open lower end and a closed upper end. Each example guide member 262 comprises a guide plate 280 and first and second guide flanges 282 and 284. First and second guide openings 286 and 288 are formed in the first and second guide flanges 282 and 284, respectively.

The example latch member 240 defines at least one engaging portion 290 and a handle portion 292. A cam surface 294 is formed on each engaging portion 290, while a biasing pin 296 (FIGS. 9-13) extends from each engaging portion 290.

To form the latch assembly 222, the at least one engaging portion 290 extends through the first and second guide openings 286 and 288 in the first and second guide flanges 282 and 284 such that the latch member 240 is supported for movement relative to the frame 220. In particular, the latch member 240 can be moved between a latched position (FIGS. 7, 9, 10, 13) and an unlatched position (FIGS. 11 and 12) relative to the frame 220. During normal use of the latch assembly 222, the latched position is above the unlatched position.

Further, the example biasing member 242 is a compression spring arranged to bias latch member 240 into the latched position. In particular, the biasing member 242 is supported at one end by the second guide flange 284 and engages the biasing pin 296 such that movement of the latch member 240 from the latched position to the unlatched position compresses the spring forming the biasing member 242. So compressed, the spring forming the biasing member 242 applies a biasing force on the latch member 240 through the biasing bin 296 that biases the latch member 240 into the latched position.

In the example latch assembly 222, the example latch member 240 defines two engaging portions 290*a* and 290*b*, and the compression springs forming the first and second biasing springs 242*a* and 242*b* are helical structures that surround portions of the engaging portions 290*a* and 290*b*. The frame 220 thus comprises two frame structures 230*a* and 230*b*, one for each of the engaging portions 290*a* and 290*b*.

The example frame structures 230*a* and 230*b* are attached to the device 122 using the end tabs 274*a* and 274*b*. Bolts, welding, or other means may be employed to detachably or rigidly secure the frame structures 230*a* and 230*b* to the device 122.

Figure 8:
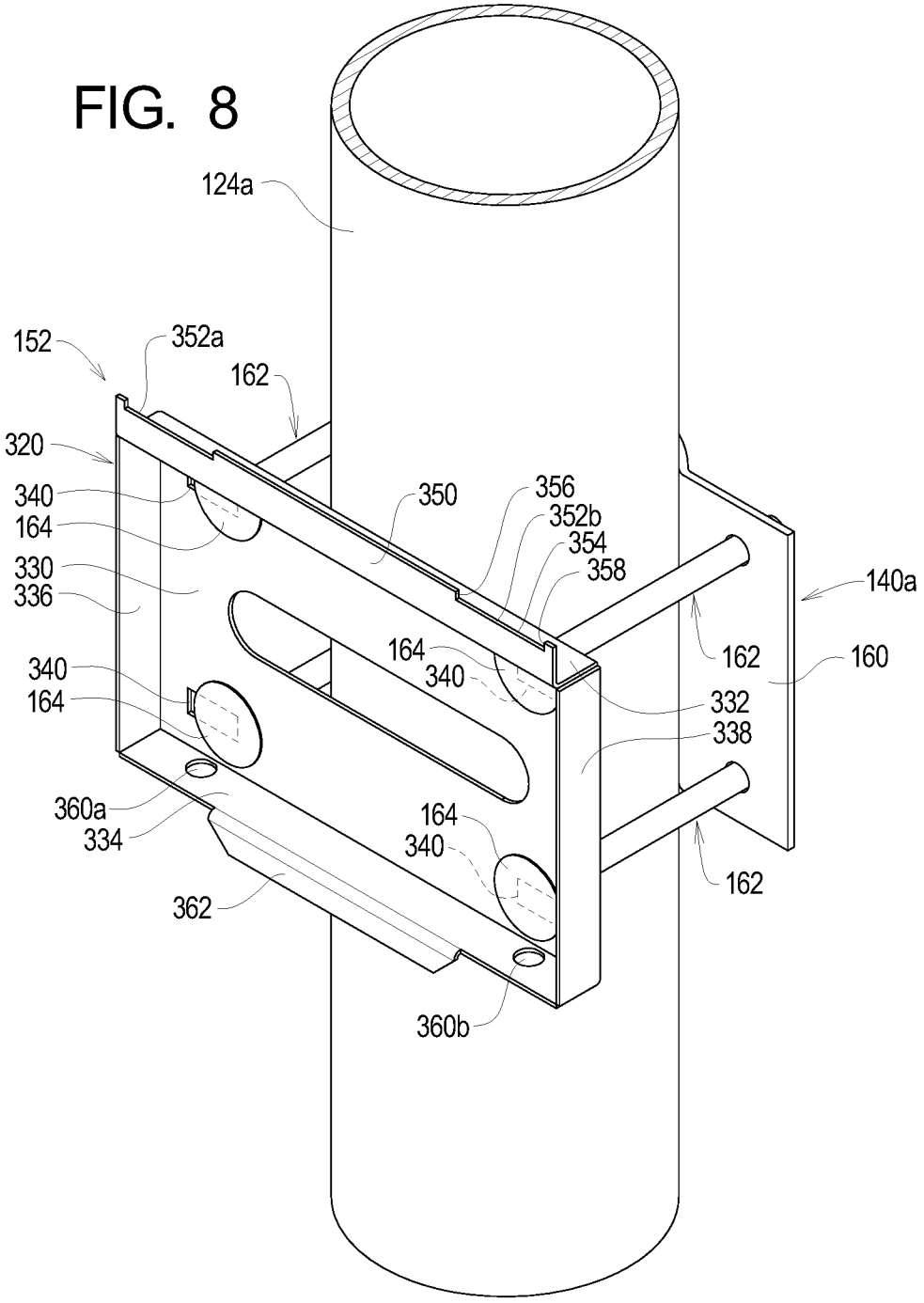
FIG. 8 is a perspective view of a first example proximal portion of the first example device attachment system of the second example mounting system for sports equipment.

Turning now to FIG. 8 of the drawing, the proximal portion 152 of the second example device attachment system 130 will now be described in further detail. The example proximal portion 152 comprises a mount 320 defining a main wall 330, a primary support wall 332, a secondary support wall 334, and first and second side walls 336 and 338. An array of mounting holes 340 is formed in the main wall 330. A primary support flange 350 extends from the example primary support wall 332, and one or more support notches 352 are formed in the example primary support flange 332. Each support notch 352 defines a main notch edge 354 and first and second side notch edges 356 and 358. At least one latch opening 360 is formed in the secondary support wall 334, and a brace flange 362 extends from the secondary support wall 334.

The example frame member 260, example guide member 262, and example mount 320 are each made of a flat metal sheet cut and bent into the shapes depicted in the drawings. The example guide member 262 may be welded or otherwise secured to the frame member 260 such that the guide member 262 rigidifies the frame member 260. The example side walls 336 and 338 of the mount may be welded or otherwise secured to the primary support wall 332 and secondary support wall 334 to rigidify the mount 320.

The bolt assemblies 162, lag screws 170, or U-bolt assemblies 180 extend through the mounting holes 340 to detachably attach the mount 320 to the structures 124*a*, 124*b*, and/or 124*c*. Tools may be required to attach the mount 320 to and detach the mount 320 from the pole 124*a*, wall 124*b*, or post 124*c*.

With the mount 320 attached to the pole 124*a*, wall 124*b*, or post 124*c*, the primary support wall 332 and secondary support wall 334 are substantially horizontal and the primary support flange 350 is substantially vertical. In this configuration, the main notch edge 354 is substantially horizontal and the side notch edges 356 and 358 are substantially vertical.

With the mount 320 so supported and the at least one frame structure 230 secured to the device 122, the device 122 is then displaced such that the frame structure(s) 230 engage and are supported by the mount 320. The example mount 320 engages the frame structure(s) 230 such that the device 122 is supported at a desired height and orientation relative to the pole 124*a*, wall 124*b*, or post 124*c*. The example mount 320 further engages the frame structures 230 to inhibit lateral and upward movement of the device 122 relative to the mount 320. Further, the latch assembly 222 engages the mount 320 to prevent pivoting and lateral movement of the device relative to the mount 320.

Referring now to FIGS. 9-13, the process of using the second example device attachment system 130 to detachably attach the device 122 to the mount 320, and thus to the pole 124*a*, wall 124*b*, and/or post 124*c* to which the mount 320 is attached, will now be described.

Figure 9:
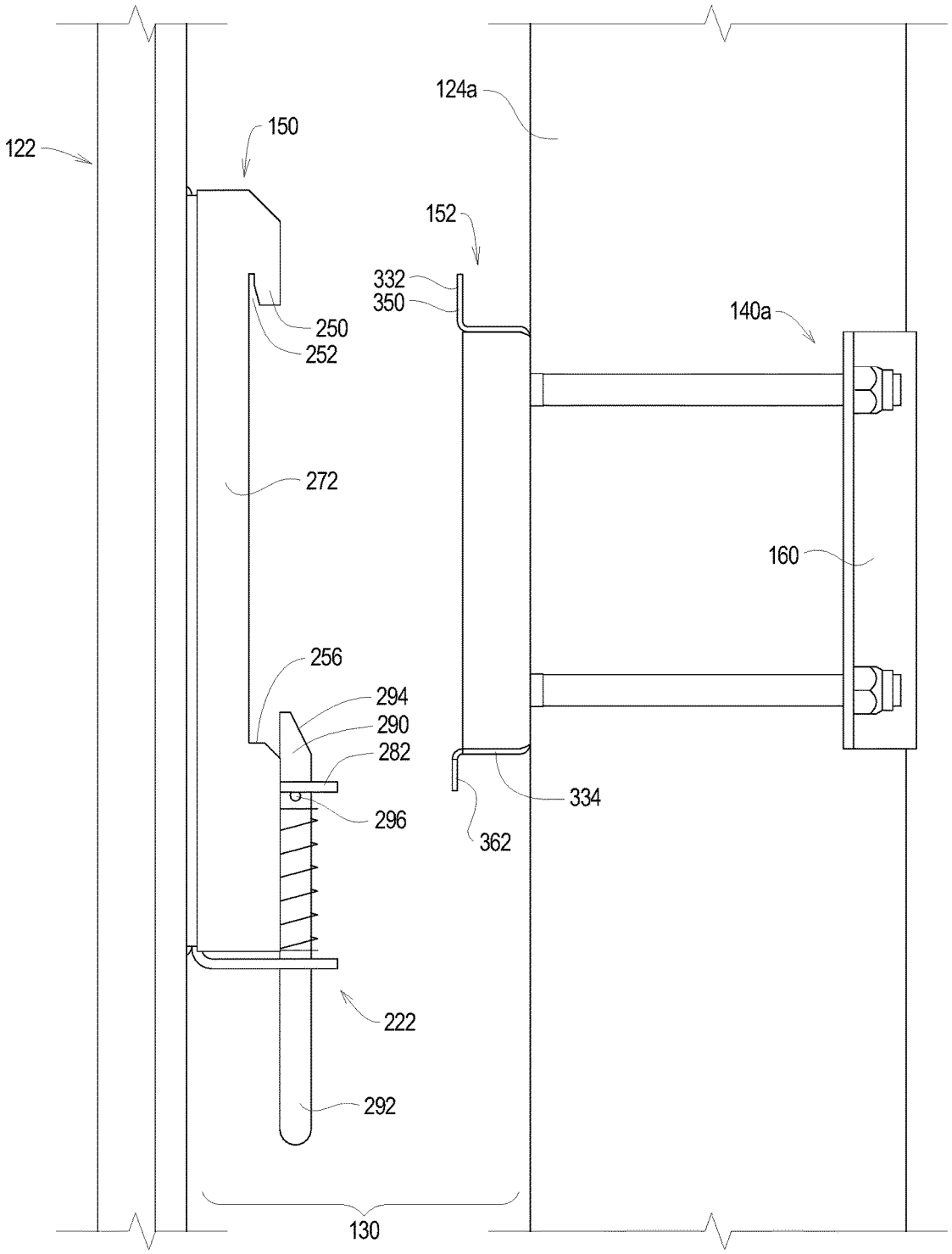
FIGS. 9-13 are side elevation views depicting the process of operatively connecting the first example distal portion to the first example proximal portion to form the first example device attachment system.
Figure 10:
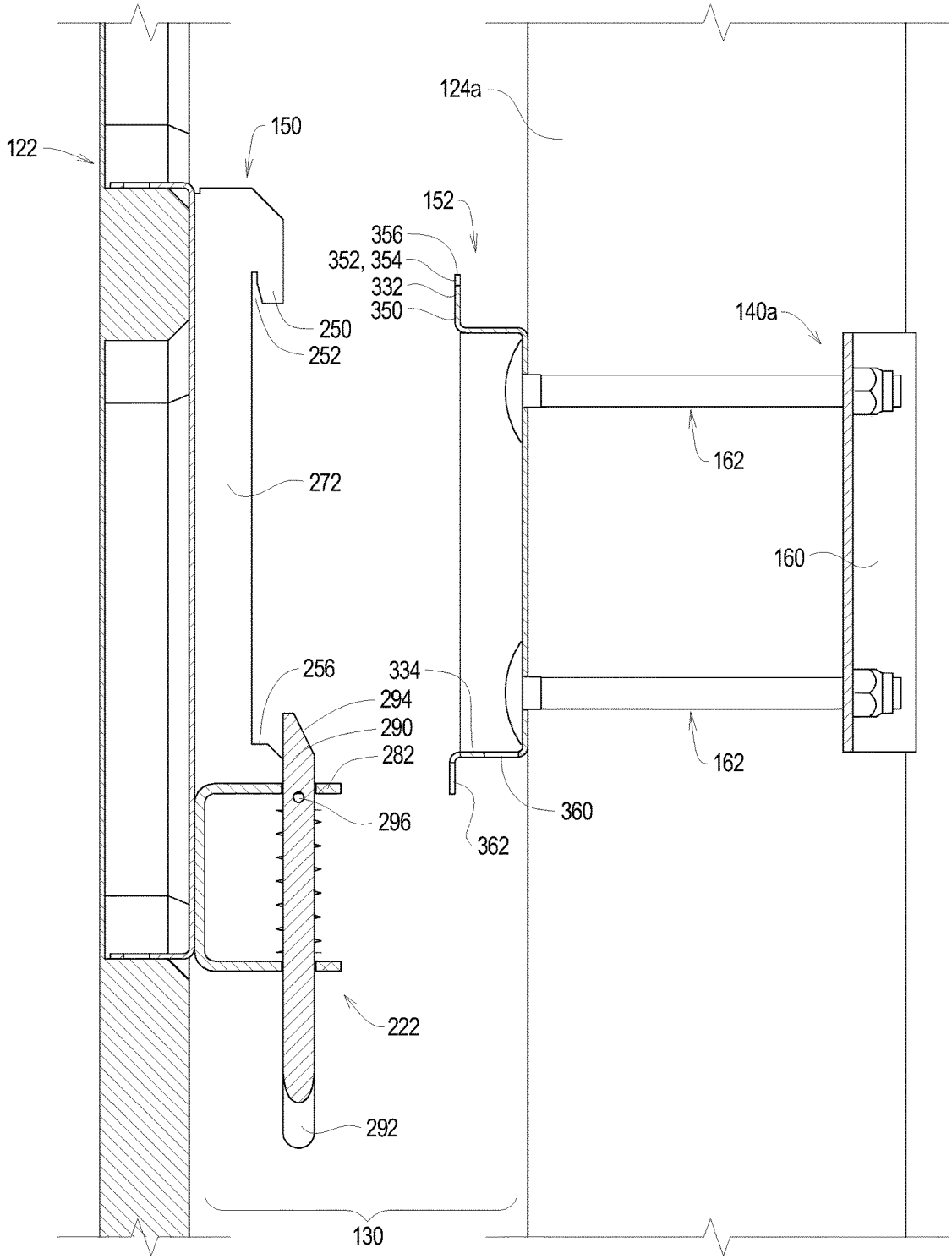
Figure 11:
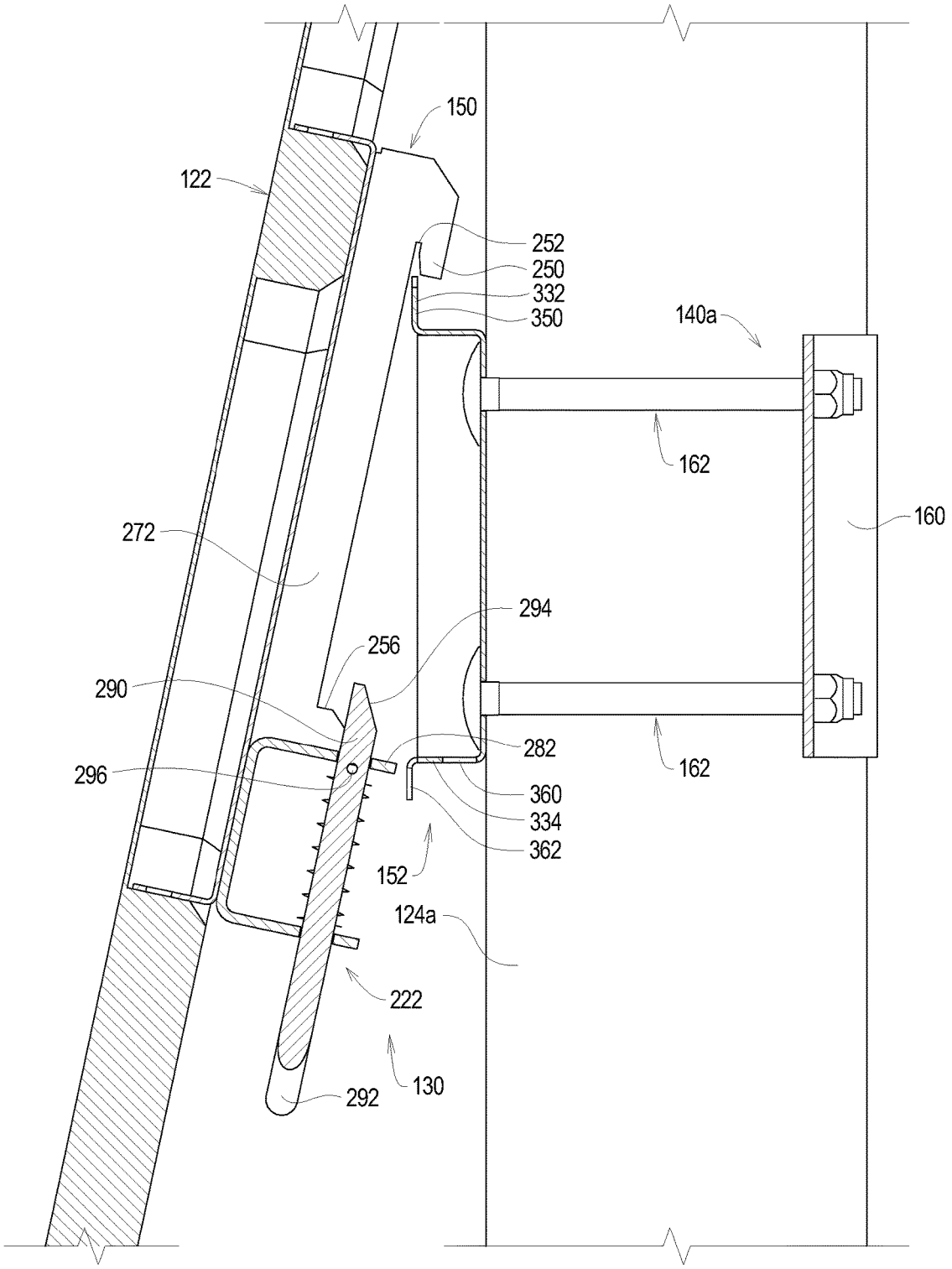
Figure 12:
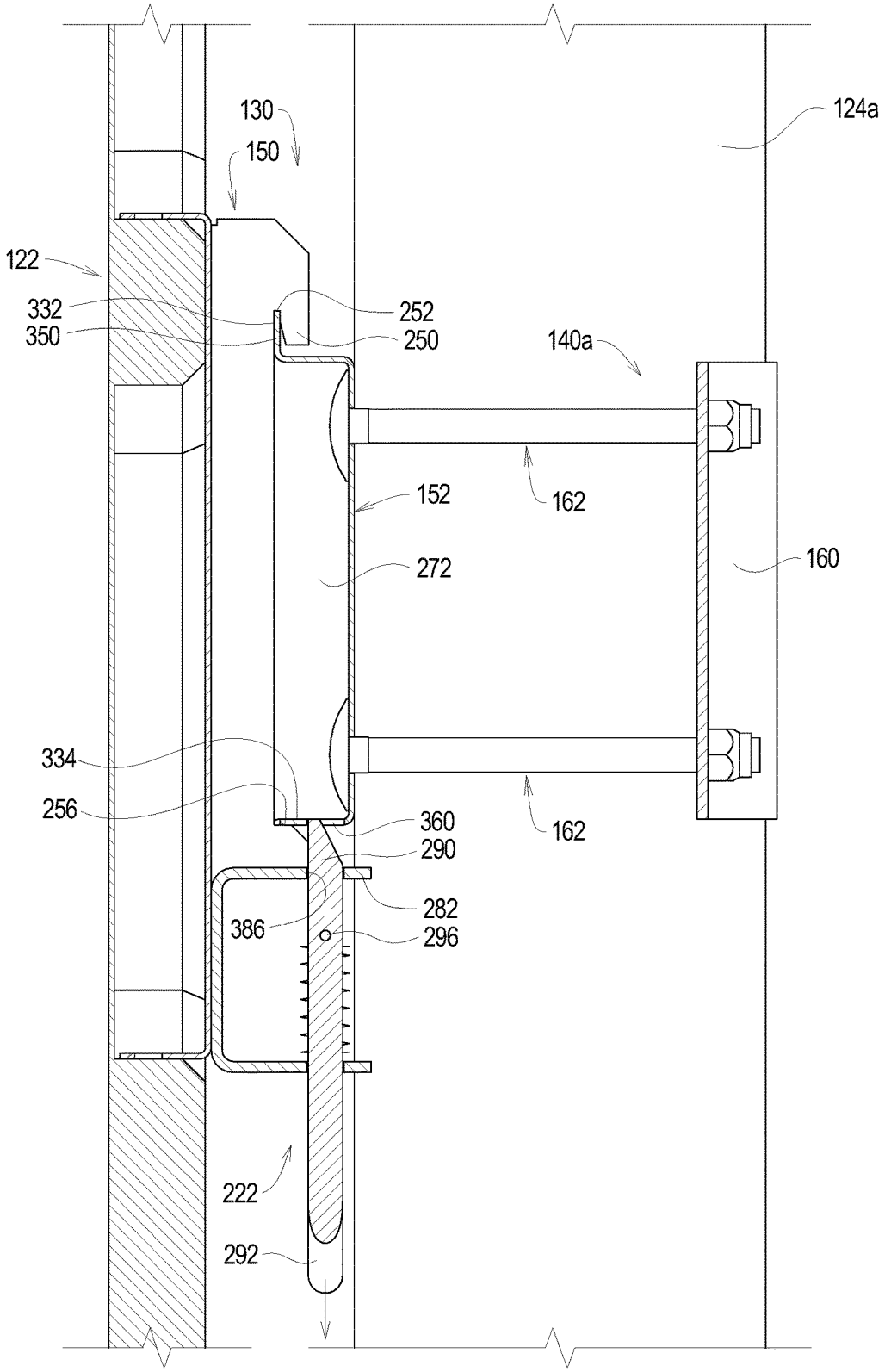
Figure 13:
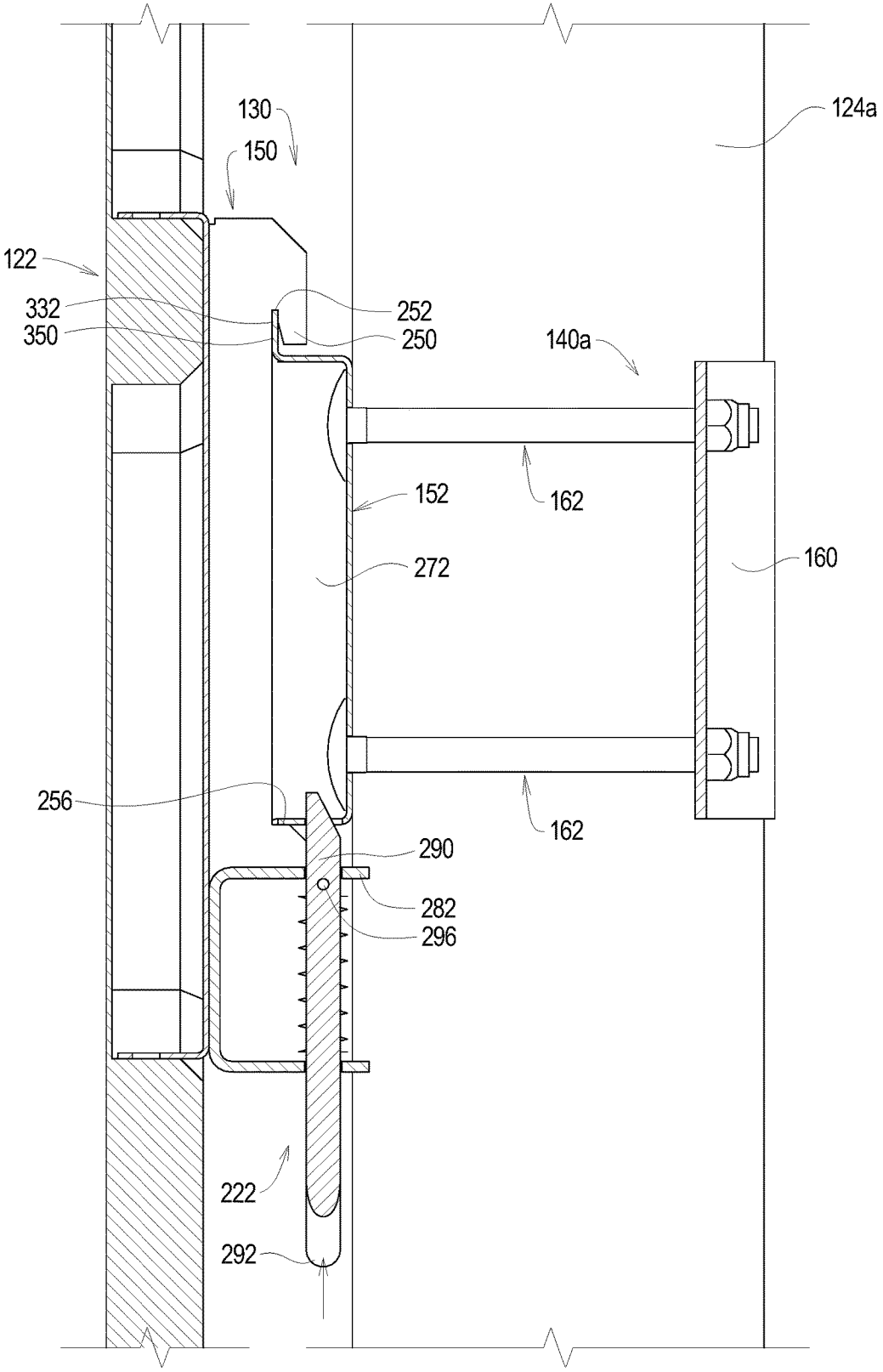

Initially, the device 122 is displaced such that the hook portions 250 are adjacent to the primary support wall 332 as shown in FIGS. 9 and 10. The device 122 is then displaced and tilted such that the hook portions 250 extend over the primary support wall 332 with the hook slots 252 above support notches 352 in the primary support flange 350 as shown in FIG. 10. The device 122 is then lowered and pivoted about a pivot axis defined by the closed ends of the hook slots 252 such that the hook slots 242 receive the primary support flange 350. With the hook portions 250 supported by the primary support flange 350, the closed ends of the hook slots 242 engage the main notch edges 354. The engagement of the hook portions 250 and the primary support wall 332 inhibits downward movement of the device 122 relative to the mount 320, while engagement of the hook portions 250 with the primary support flange 350 inhibits front and back movement of the device 122 relative to the mount 320.

With the hook slots 252 supported by the primary support flange 350, the hook portions 250 further abut one of the side notch edges 356 and 358 adjacent thereto. Engagement of the hook portions 250 with the side notch edges 356 and 358 inhibits lateral movement of the device 122 relative to the mount 320.

With the hook slots 252 supported by the primary support flange 350, the side flanges 272 engage the secondary support wall 334 to prevent rearward rotation of the device 122 about the pivot axis defined by the closed ends of the hook slots 252. Further, the innermost side flanges 272 of the frame members 260 are arranged to the outside of the brace flange 362 extending from the secondary support wall 334. Engagement of the innermost side flanges 272 with the brace flange 362 inhibits lateral movement of the device 122 relative to the mount 320.

Additionally, when the hook slots 252 receive the primary support flange 350, the first guide flange 282 is below and adjacent to, or perhaps in contact with, the secondary support wall 334. In the example shown, four of the stop edges 256 engage the secondary support wall 334 to inhibit upward movement of the device 122 relative to the mount 320.

When the latch member 240 is in the latched configuration, the engaging portion(s) 290 thereof extend through the latch openings 360 in the secondary support wall 334. The latch assembly 222 thus further engages the secondary support wall 334 to prevent forward rotation of the device 122 about the pivot axis defined by the closed ends of the hook slots 252.

In particular, the example latch assembly 222 is configured to be displaced from the latched position to the unlatched position as the device 122 is lowered and pivoted onto the mount 320. In particular, after the hook portion(s) 250 engage the primary support flange 350, allowing the device 122 to pivot causes the cam surfaces 294 on the engaging portions 290 of the latch member 240 engage the secondary support wall 334 such that a force is applied to the latch member 240 against the biasing force of the biasing member(s) 242. The latch member 240 is thus displaced into its unlatched configuration and is held there until the device 122 is substantially parallel to the main wall 330 of the mount 320. At this point, the engaging portion(s) 290 are aligned with the latch opening(s) 360. When the engaging portion(s) 290 are aligned with the latch opening(s) 360, the biasing member(s) 242 return the latch member(s) 240 to the latched configuration. At this point, the second example device attachment system 130 is in its latched configuration.

The process is substantially reversed to remove the device 122 from the mount 320. Initially, the handle portion 292 is grasped, and the latch member 240 is displaced against the force of the biasing member 242 such that the latch member 240 is in the unlatched position. At this point, the second example device attachment system 130 is in its unlatched configuration. The device 122 may be rotated upwardly about the pivot axis and lifted such that the distal portion 150 is disengaged from the proximal portion 152.

In the second example sports mounting system 320, the device 122 may be moved from the pole 124*a*, to the wall 124*b*, or to the post 124*c*. In this case, three of the mounts 320, each with an associated structure attachment systems 140*a*, 140*b*, or 140*c*, are used. With the structure attachment systems 140*a*, 140*b*, and/or 140*c* in place, the second example sports mounting system 320 may thus be easily and quickly moved to various locations depending on the user's needs without the use of tools.

Figure 16:
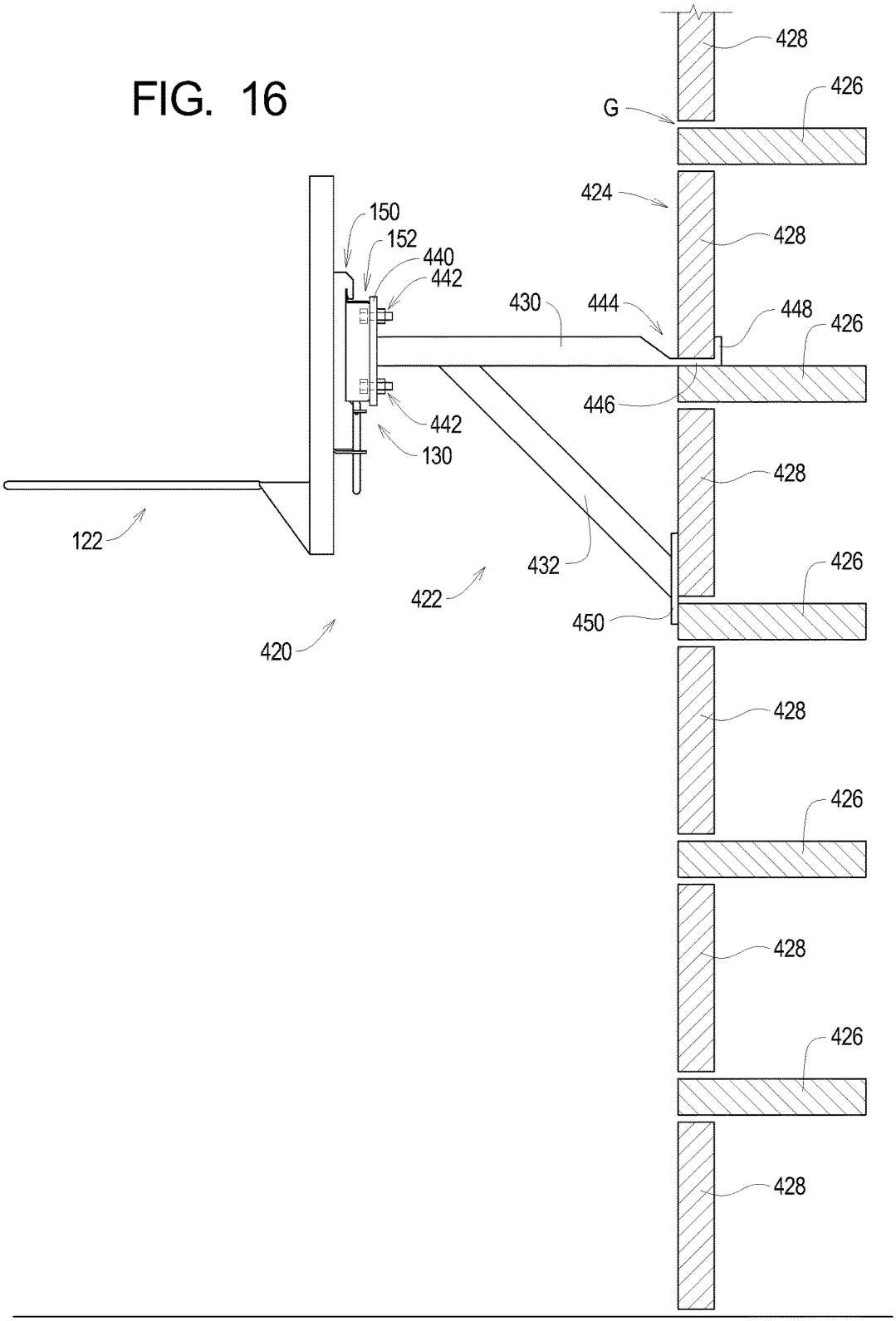
FIG. 16 is a side elevation view depicting a fourth example structure attachment system and a fourth example structure.

Referring now to FIG. 16, depicted therein is a third example sports mounting system 420 constructed in accordance with, and embodying, the principles of the present invention. The third example sports mounting system 420 comprises a fourth example structure attachment system 422 adapted to mount the sport device 122 and second example device attachment system 130 to a bleacher assembly 424 comprising bleacher seats 426 and backrests 428.

The fourth example structure attachment system 422 comprises a support arm 430 and a brace arm 432. In use, the example support arm 430 supports a support plate 440 in a predetermined orientation relative to the bleacher assembly 424. In the fourth example structure attachment system 430, bolt assemblies 442 are used to secure the proximal portion 152 of the second example device attachment system 130 to the support plate 440. Optionally, the proximal portion of the second device attachment system 130 may be integrally formed with the support plate. As another alternative, the proximal portion may be directly attached to or integrally formed with the support arm 430.

The example support arm 430 further comprises a hook portion 444 defining a gap portion 446 and a return portion 448. The gap portion 446 is sized and dimensioned to fit within a gap G defined by the bleacher seats 426 and the bleacher backrests 428 when the bleacher assembly 424 is in its closed configuration as shown in FIG. 16. The return portion 448 is sized and dimensioned to engage at least a portion of the bleacher assembly 424, in this case the inner surface of one of the bleacher backrests 428, to inhibit movement of the proximal end of the bleacher arm 430 through the gap G. Padding may be used to inhibit marring of the bleacher assembly 424 by the hook portion 444.

The example brace arm 432 extends from the distal end of the support arm 430 adjacent to the support plate 440 to a region of the bleacher assembly 424 below the region at which the hook portion 444 engages the bleacher assembly 424. A brace plate 450 is secured to the brace arm 432 to distribute forces transmitted through the brace arm to the bleacher assembly 424. Padding may be used to inhibit marring of the bleacher assembly 424 by the brace plate 450.

The fourth example structure attachment system 422 allows the example device 122 to be detachably attached to the bleacher assembly 424 to increase the number of basketball goals in a gymnasium that are available to smaller children.

Figure 17:
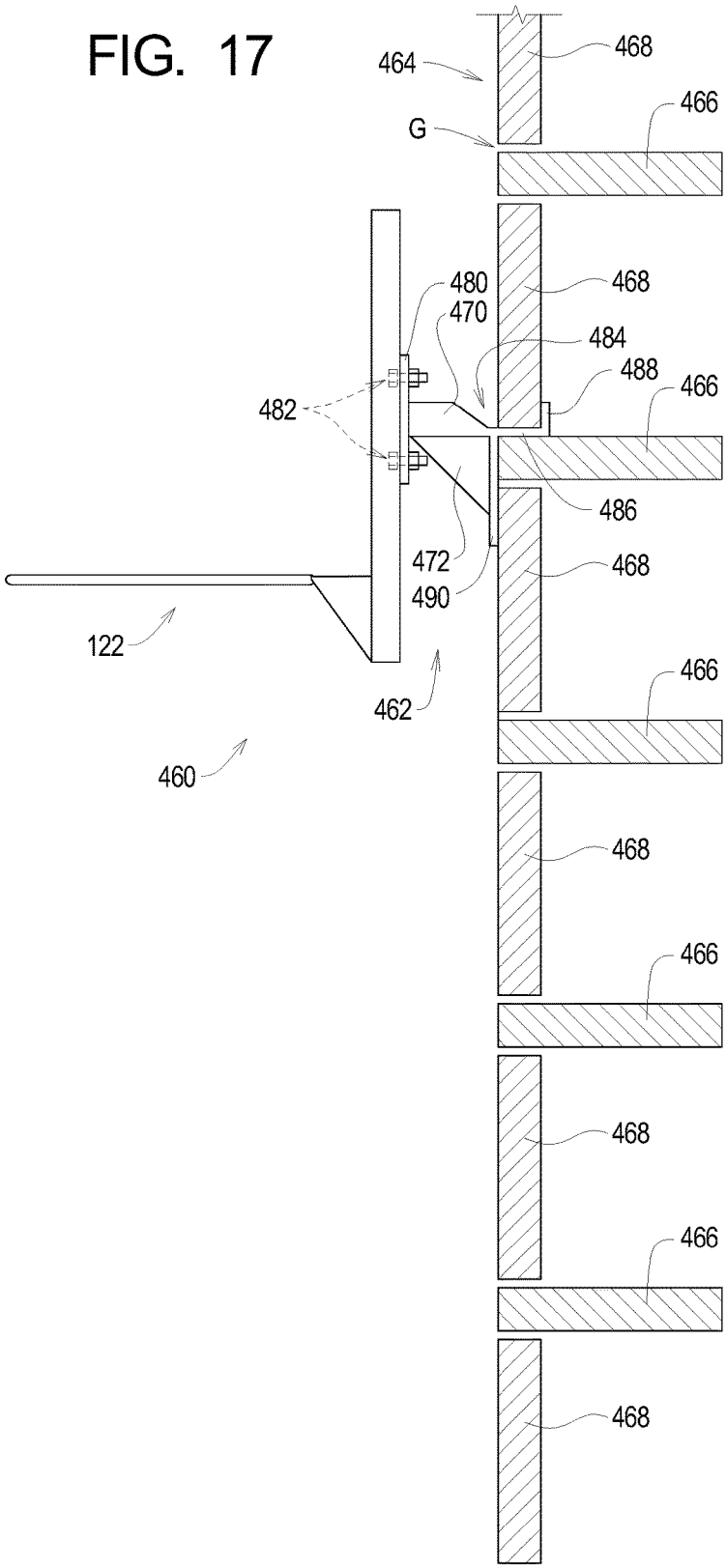
FIG. 17 is a side elevation view depicting a fifth example structure attachment system that may be used with the fourth example structure.
Figure 18:
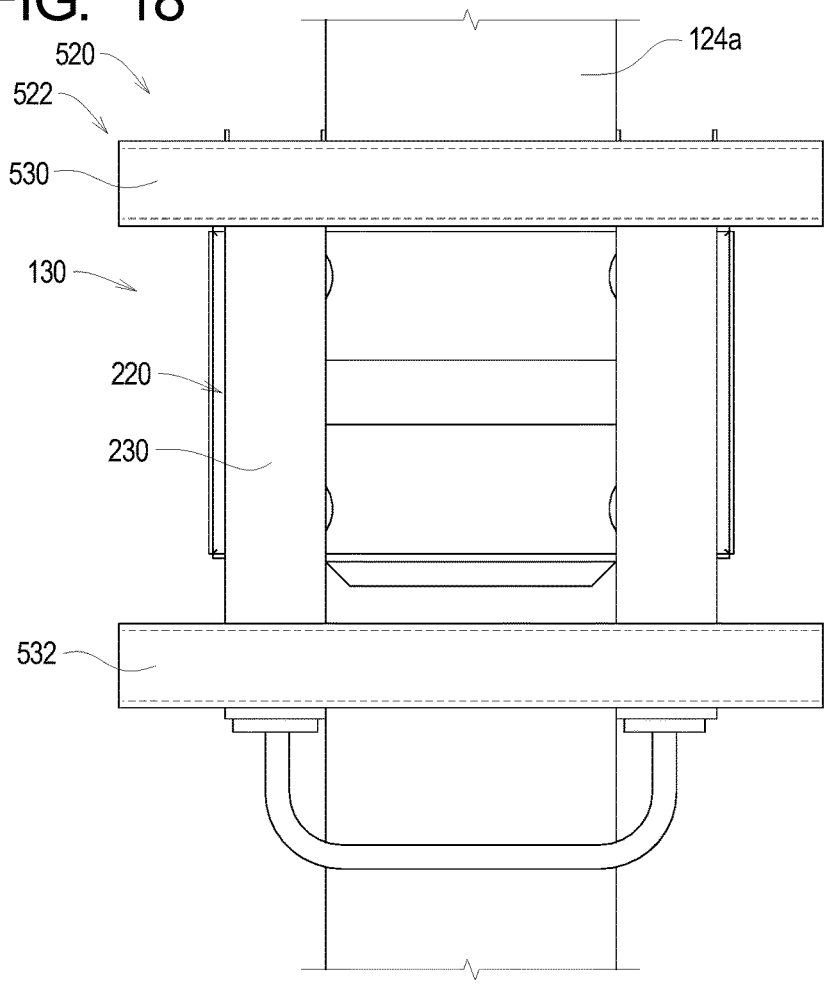
FIG. 18 is a front elevation view of an intermediate portion of a second example sport device assembly.
Figure 19:
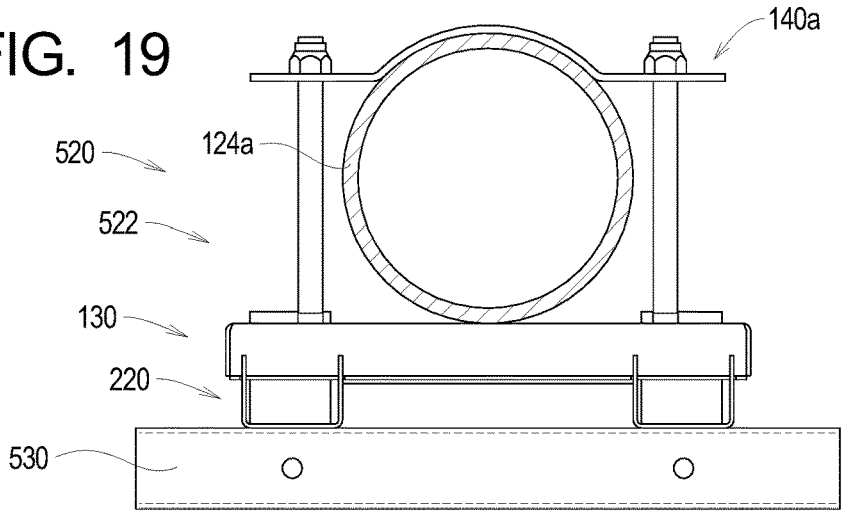
FIG. 19 is a top elevation view of the intermediate portion of the second example sport device assembly.
Figure 20:
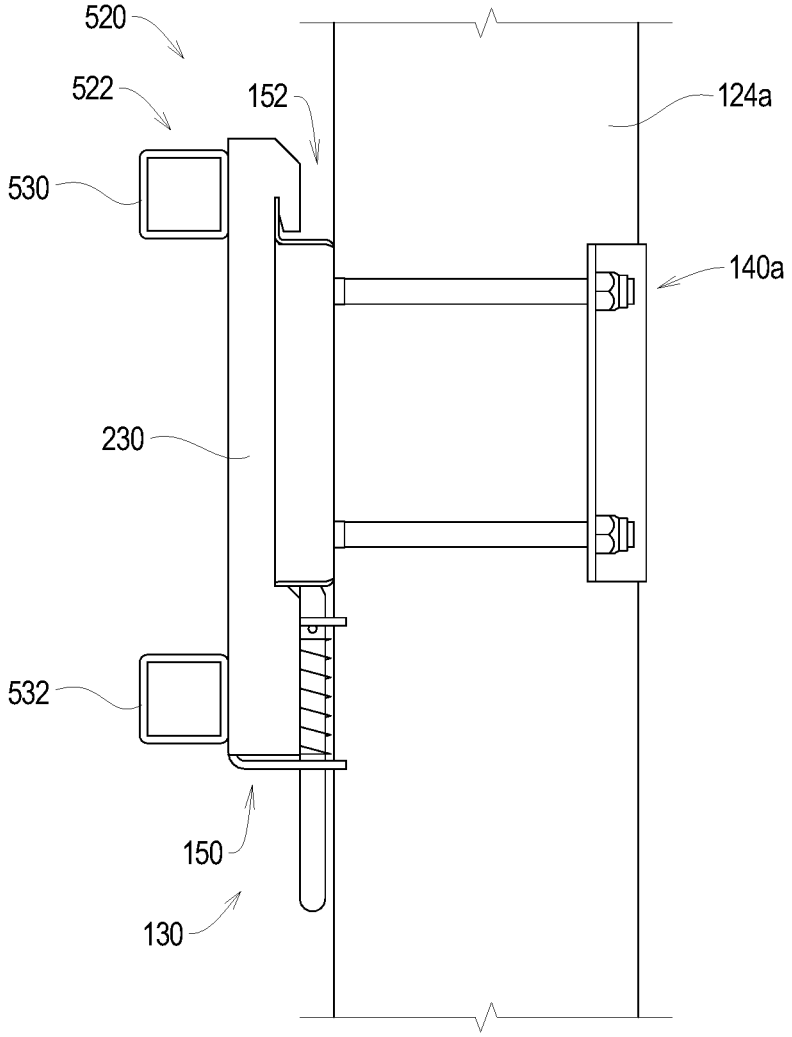
FIG. 20 is a side elevation view of the intermediate portion of the second example sport device assembly.

Referring now to FIG. 17, depicted therein is a fourth example sports mounting system 460 constructed in accordance with, and embodying, the principles of the present invention. The fourth example sports mounting system 460 comprises a fifth example structure attachment system 462 adapted to mount the sport device 122 to a bleacher assembly 464 comprising bleacher seats 466 and backrests 468.

The fourth example structure attachment system 462 comprises a support portion 470 and a brace portion 472. In use, the example support portion 470 supports a support plate 480 in a predetermined orientation relative to the bleacher assembly 464. In the fourth example structure attachment system 462, bolt assemblies 482 are used to secure the device 122 directly to the support plate 480. Optionally, the device may be integrally formed with the support plate. As another alternative, the device may be directly attached to or integrally formed with the support portion 470.

The example support portion 470 further comprises a hook portion 484 defining a gap portion 486 and a return portion 488. The gap portion 486 is sized and dimensioned to fit within a gap G defined by the bleacher seats 466 and the bleacher backrests 468 when the bleacher assembly 464 is in its closed configuration as shown in FIG. 17. The return portion 488 is sized and dimensioned to engage at least a portion of the bleacher assembly 464, in this case the inner surface of one of the bleacher backrests 468, to inhibit movement of the proximal end of the bleacher arm 470 through the gap G. Padding may be used to inhibit marring of the bleacher assembly 464 by the hook portion 484.

The example brace portion 472 engages a region of the bleacher assembly 464 below the region at which the hook portion 484 engages the bleacher assembly 464. A brace plate 490 is secured to the brace portion 472 to distribute forces transmitted through the brace arm to the bleacher assembly 464. Padding may be used to inhibit marring of the bleacher assembly 464 by the brace plate 490.

The fifth example structure attachment system 462 allows the example device 122 to be detachably attached to the bleacher assembly 464 to increase the number of basketball goals in a gymnasium that are available to smaller children.

Figure 21:
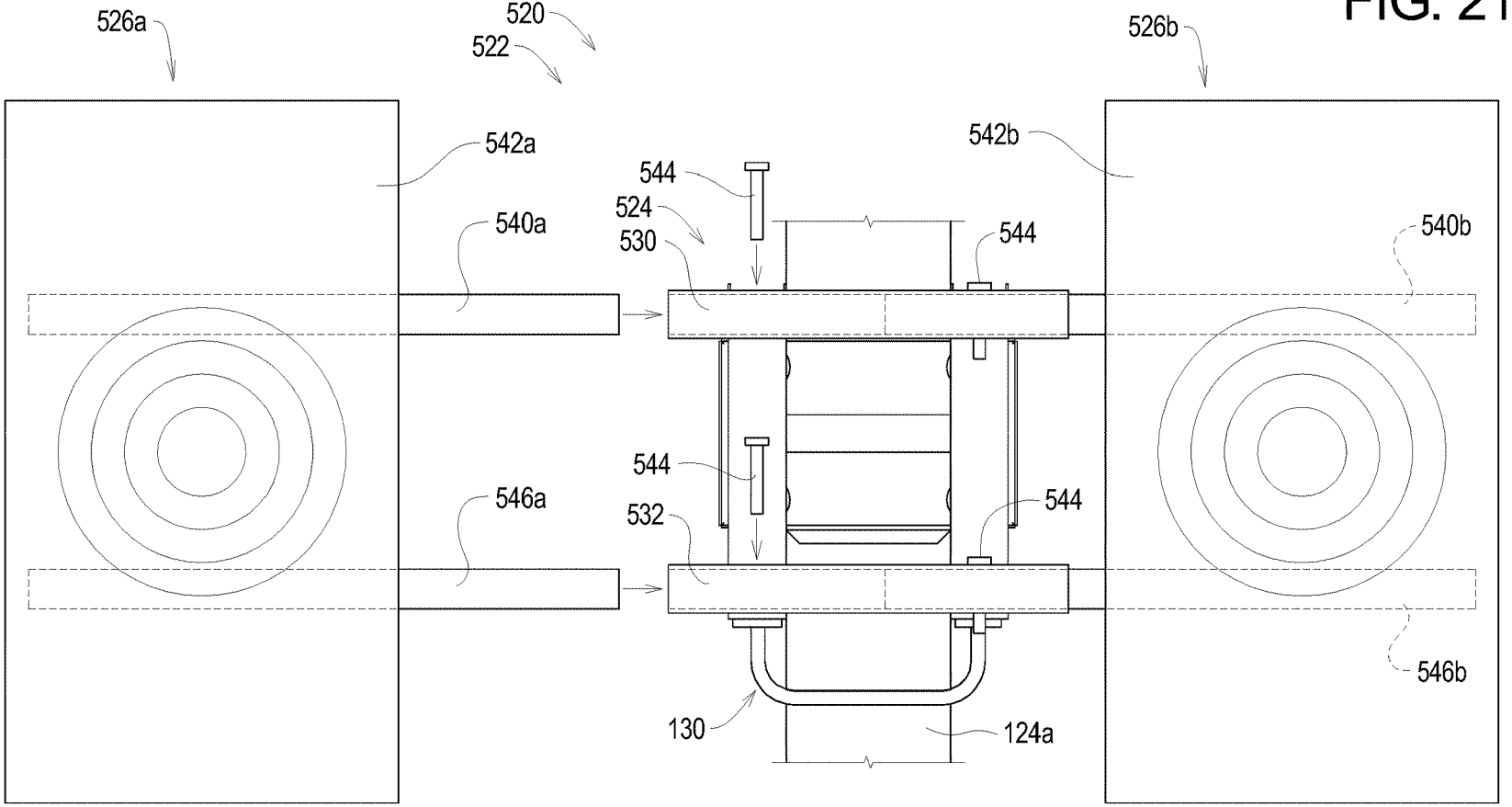
FIG. 21 is a front elevation view depicting the attachment of a first example target portion of the second example sport device assembly to the intermediate portion thereof.
Figure 22:
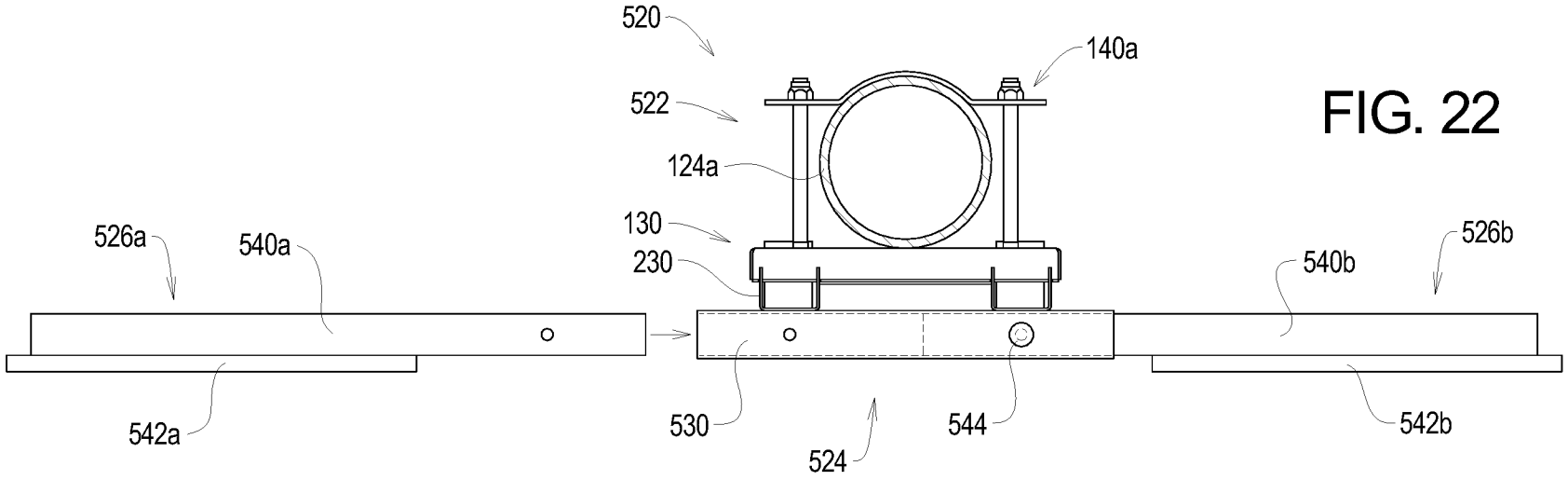
FIG. 22 is a top plan view depicting the attachment of the first example target portion to the intermediate portion of the second example sport device assembly.
Figure 23:
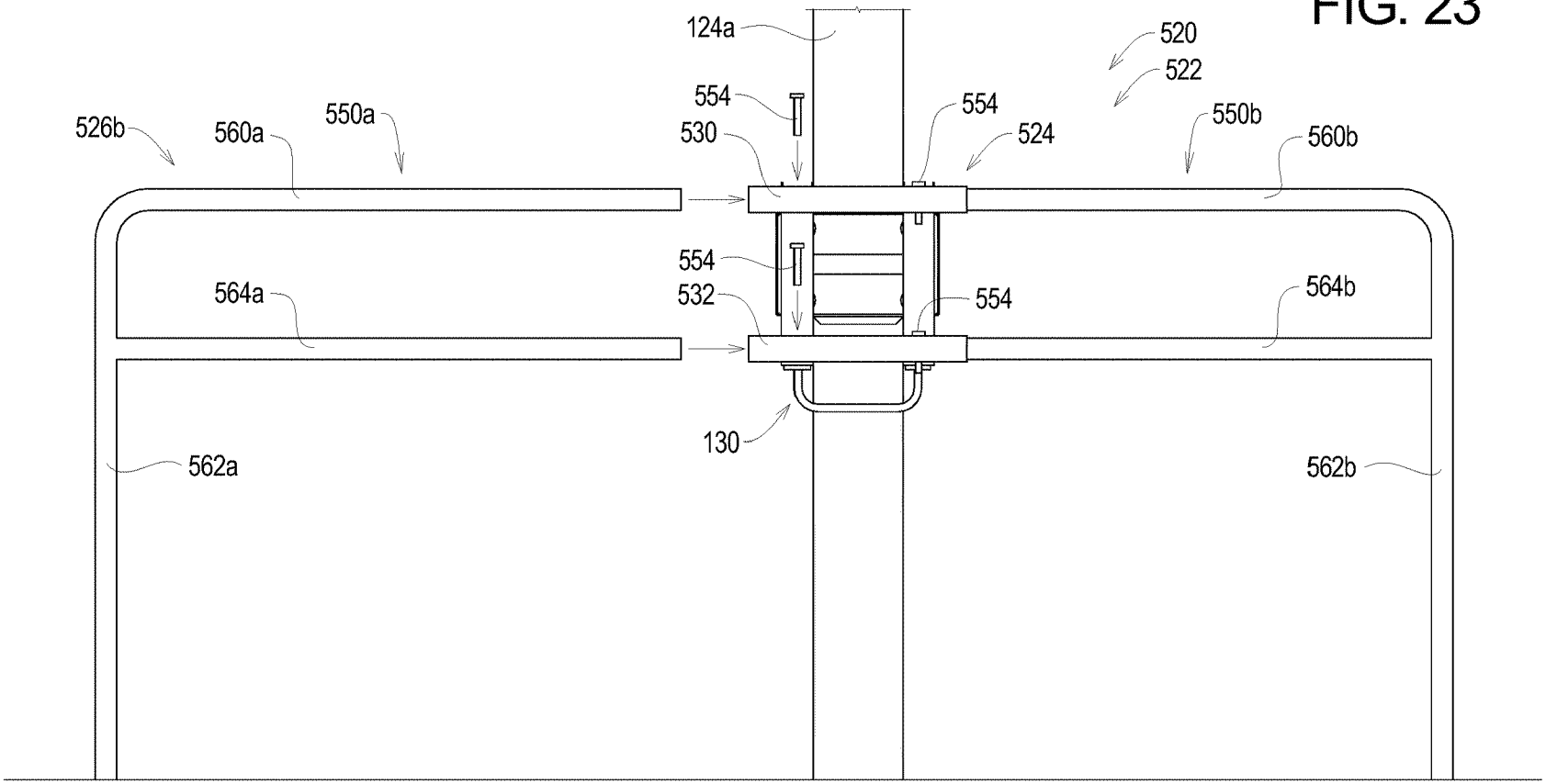
FIGS. 23 and 24 are front elevation views depicting the process of attaching a second example target portion of the second example sport device assembly to the intermediate portion thereof.
Figure 24:
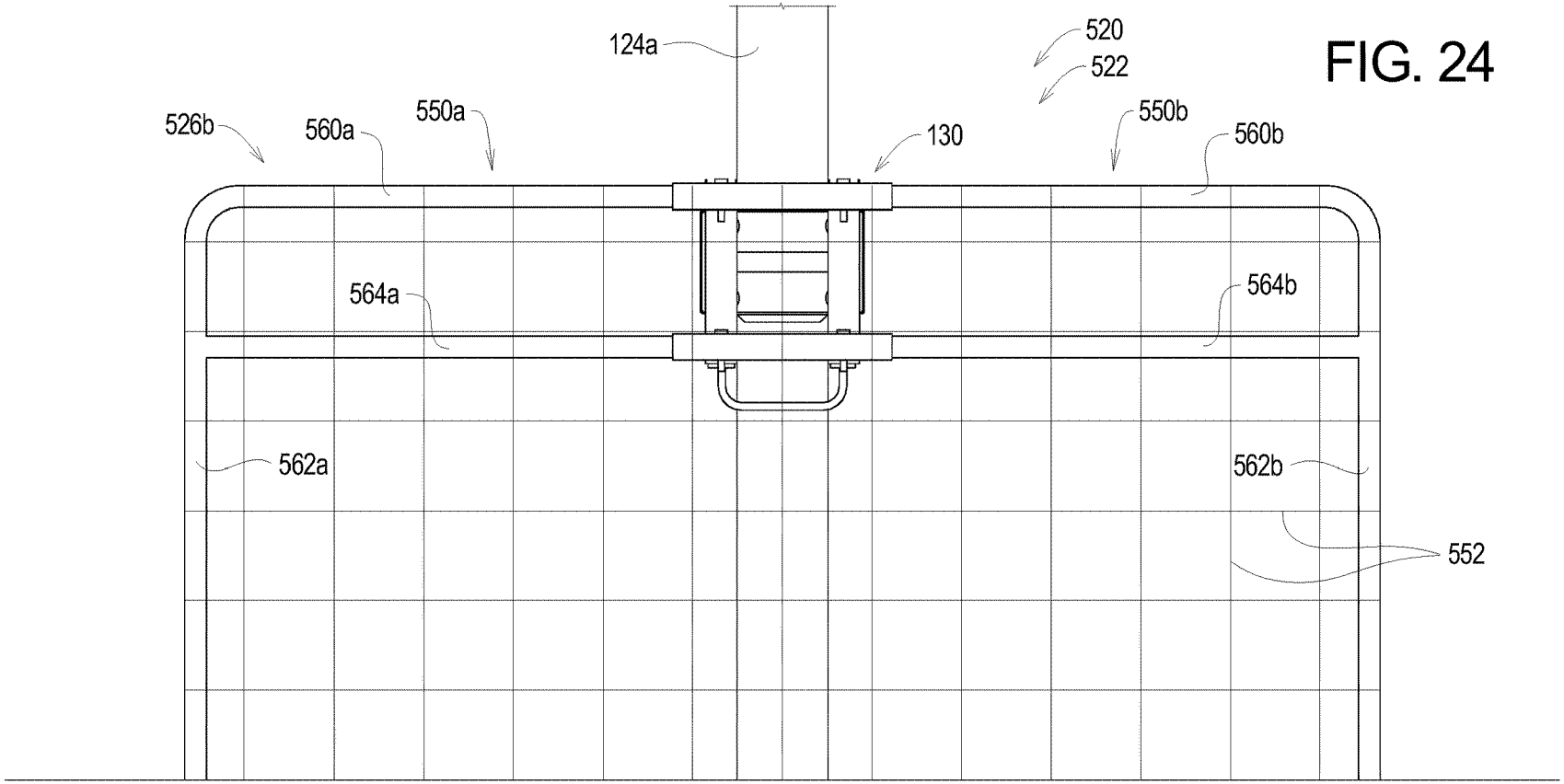

Referring now to FIGS. 18-24, depicted therein is a fifth example sports mounting system 520 constructed in accordance with, and embodying, the principles of the present invention. The fifth example sports mounting system 520 comprises a reconfigurable sport device assembly 522 comprising an intermediate portion 524 and a target portion 526. The target portion 526 can take different forms. FIGS. 21 and 22 depict a first example target portion 526*a* in the form of one or more offset throwing targets for sports such as baseball or football. FIGS. 23 and 24 depict a second example target portion 526*b* in the form of a soccer goal.

The reconfigurable device assembly 522 may be used with the device attachment system 130 and structure attachment system 140*a* to support the target portion 526 relative to the pole 124*a* as depicted in FIGS. 18-24. However, the example reconfigurable device assembly 522 may also be used with other structure attachment systems such as the structure attachment systems 140*b*, 140*c*, 422, and 462 described above and other structures such as the wall 124*b*, post 124*c*, or bleacher assemblies 424 and 464 described above.

The example intermediate portion 524 of the example reconfigurable device assembly 522 comprises a first mounting tube 530. The illustrated example of the intermediate portion 524 additionally optionally comprises a second mounting tube 532. The mounting tubes 530 and 532 are rigidly connected to the frame structures 230 of the frame 220 of the distal portion 150 of the device attachment system 130.

The first example target system 526*a* comprises at least one primary offset tube 540, at least one target plate 542 supported by the first offset tube 540, and at least one retaining pin 544. The first example target system 526*a* further comprises at least one secondary offset tube 546 that also supports the target plate 542. The example primary offset tubes 540 and secondary offset tubes 546 are attached to the target plate 542 such that the spacing therebetween is the same as a spacing between the mounting tubes 530 and 532. The offset tubes 540 and 546 are sized and dimensioned to fit within at least a portion of the mounting tubes 530 and 532. With the offset tubes 540 and 546 within at least a portion of the mounting tubes 530 and 532, the retaining pins 544 are inserted through the mated pairs of tubes 540 and 530 and tubes 546 and 532 to inhibit removal of the offset tubes 540 and 546 from the mounting tubes 530 and 532, respectively. The offset tubes 540 and 546 thus support the at least one target plate 542 in a desired relationship to the pole 124*a* or other structure as desired.

The illustrated example of the first example target system comprises first and second primary offset tubes 540*a* and 540*b*, first and second secondary offset tubes 546*a* and 546*b*, first and second target plates 542*a* and 542*b*, and a plurality of retaining pins 544. The first and second target plates 542*a* and 542*b* are supported on either side of the pole 124*a* as depicted in FIG. 21.

The second example target system 526*b* comprises at least one frame structure 550, a net 552, and one or more retaining pins 554. The at least one frame structure comprises a primary lateral tube 560, a side tube 562, and, optionally, a secondary lateral tube 564. The primary and secondary lateral tubes 560 and 564 are rigidly connected to the side tube 562 such that the lateral tubes 560 and 564 are spaced from each other a distance equal to that between the primary and secondary mounting tubes 530 and 532. The lateral tubes 560 and 564 are further sized and dimensioned to fit within at least a portion of the mounting tubes 530 and 532. With the lateral tubes 560 and 564 within at least a portion of the mounting tubes 530 and 532, the retaining pins 554 are inserted through the mated pairs of tubes 560 and 530 and tubes 564 and 532 to inhibit removal of the lateral tubes 560 and 564 from the mounting tubes 530 and 532, respectively. The lateral tubes 560 and 564 thus support at least one frame structure 550 in a desired relationship to the pole 124*a* or other structure as desired.

The illustrated example of the second example target system 526*b* comprises first and second frame structures 550*a* and 550*b*. Accordingly, the second example target system 526*b* comprises first and second primary offset tubes 560*a* and 560*b*, first and second secondary offset tubes 564*a* and 564*b*, and a plurality of retaining pins 554. The primary and secondary frame structures 550*a* and 550*b* are supported on either side of the pole 124*a* as depicted in FIGS. 23 and 24. The net 552 is supported by the frame structures 550*a* and 550*b* to form a soccer goal as depicted in FIG. 24.

Figure 25:
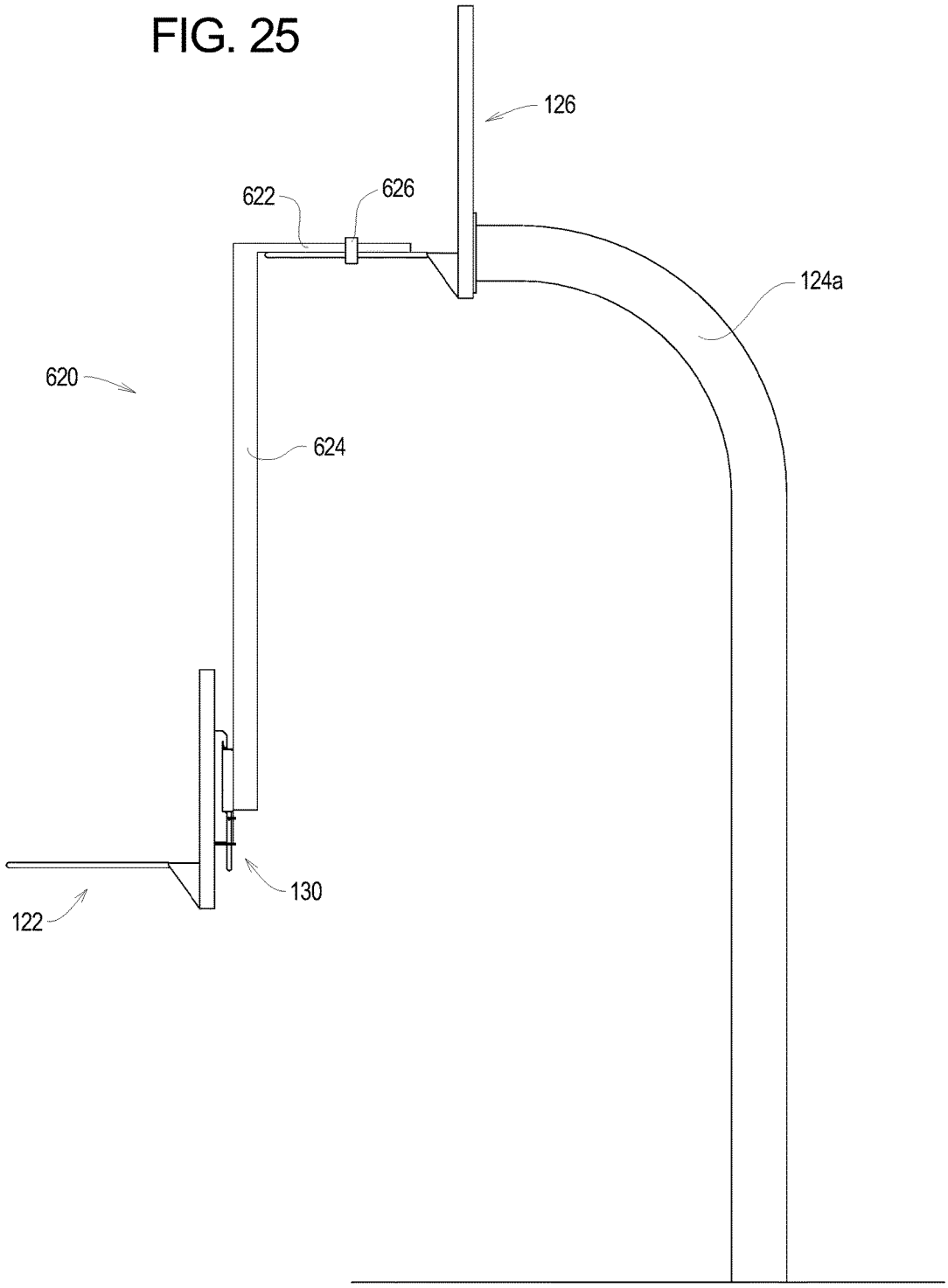
FIG. 25 is a side elevation view depicting a sixth example structure attachment system that may be used with the first example structure.
Figure 26:
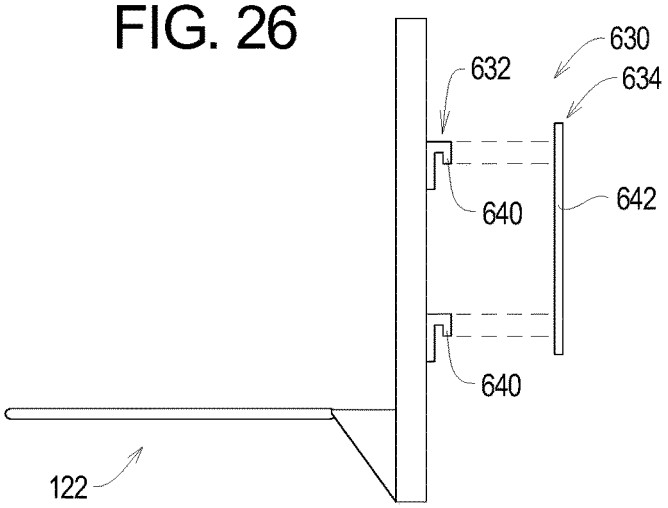
FIG. 26 is a side elevation view of a third example device attachment system of the present invention.
Figure 27:
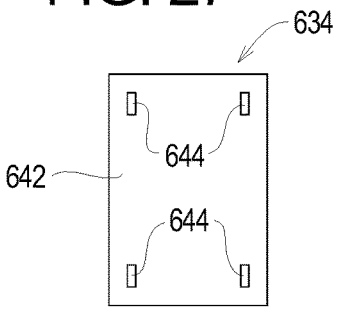
FIG. 27 is a side elevation view of a proximal portion of the third example device attachment system.

FIG. 25 illustrates sixth example structure attachment system 620 that may be used to attach the device 122 to the example structure 124*a* depicted above. The example structure attachment system comprises a primary device engaging portion 622 and a drop portion 624. The primary device engaging portion 622 is configured to engage the primary device 126 such that the drop portion 624 supports the device attachment system 130 at a desired location relative to the primary device 126. The example primary device engaging portion 622 is an at least partly circular structure sized and dimensioned to engage the hoop portion of the primary device 122. One or more straps 626 may be arranged to secure the primary device engaging portion 622 relative to the primary device 126.

Figure 28:
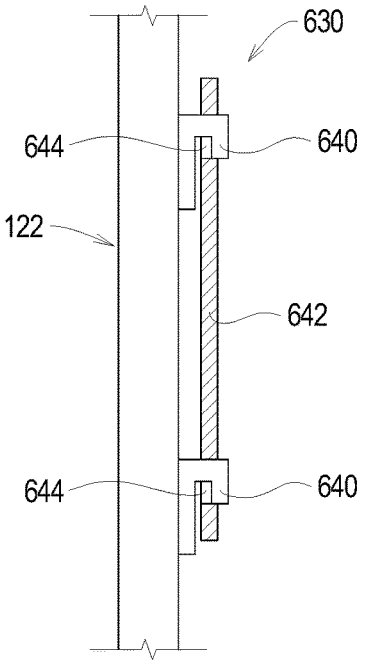
FIGS. 28 and 29 are side elevation views of the process of forming the third example device attachment system.
Figure 29:
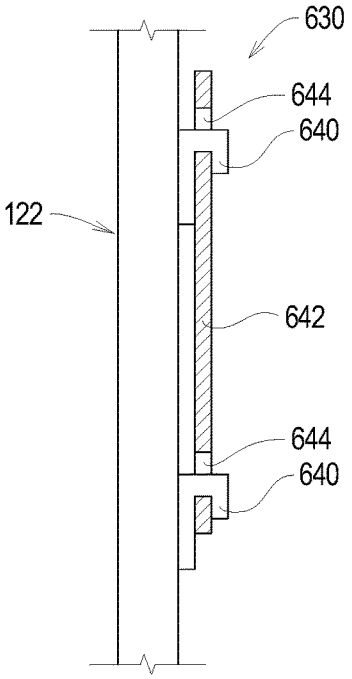

FIGS. 26-29 illustrate a third example device attachment system 630 of the present invention. The third example device attachment system 630 comprising a distal portion 632 and a proximal portion 634. The distal portion 632 is formed by a plurality of hook portions 640 rigidly attached to the example device 122. The proximal portion 634 comprises a plate 642 in which a plurality of slots 644 is formed. The plate 642 is attached to a structure such as any of the structures recited herein using a structure attachment system such as any of the structure attachment systems described herein. The hook portions 640 engage the slots 644 as shown in FIGS. 28 and 29 to secure the device 122 relative to the structure.

Figure 30:
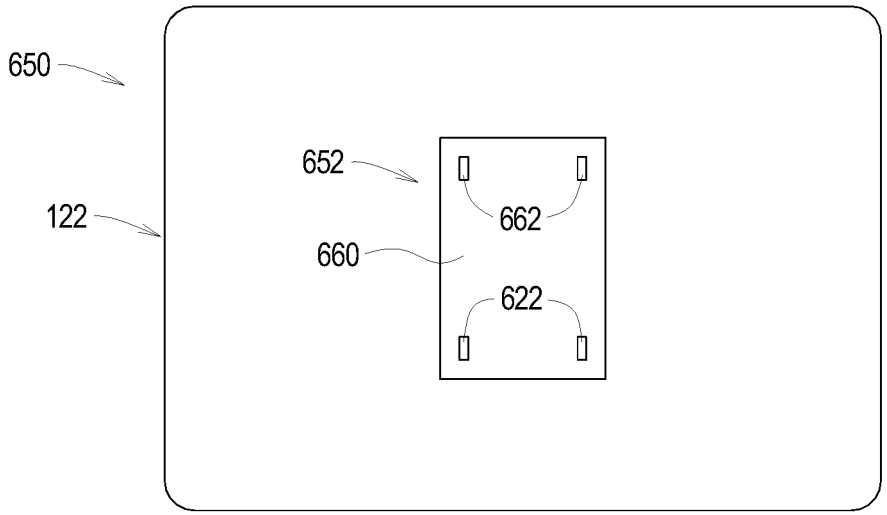
FIG. 30 is a rear elevation view depicting a distal portion of a fourth example device attachment system of the present invention.
Figure 31:
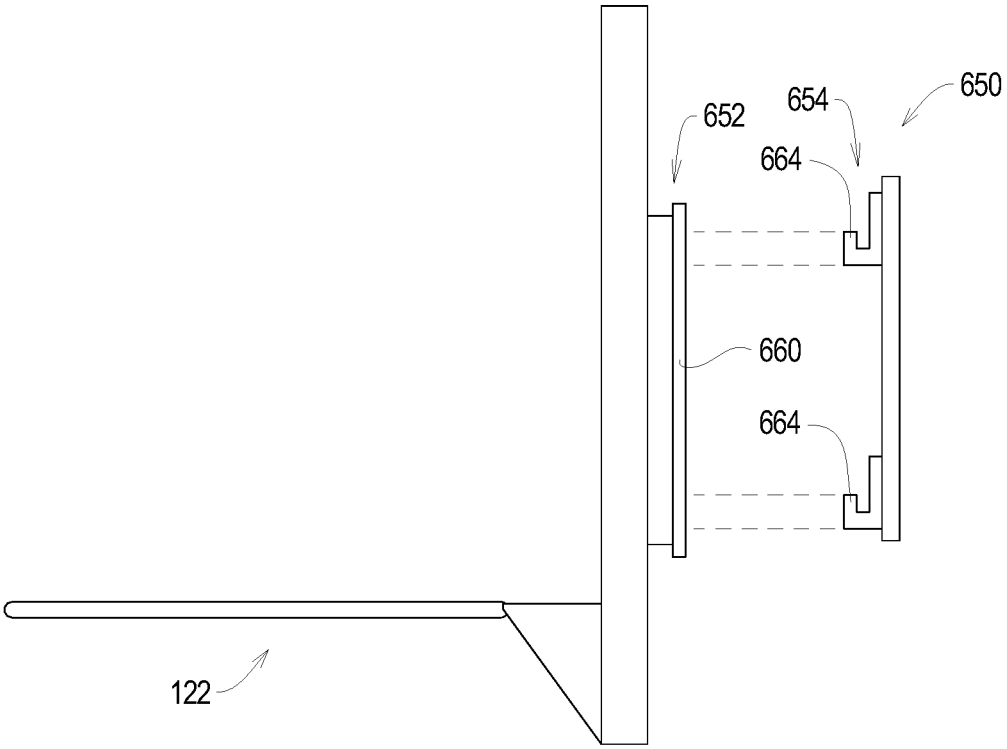
FIG. 31 is a side elevation view of the process of forming the fourth example device attachment system.
Figure 32:
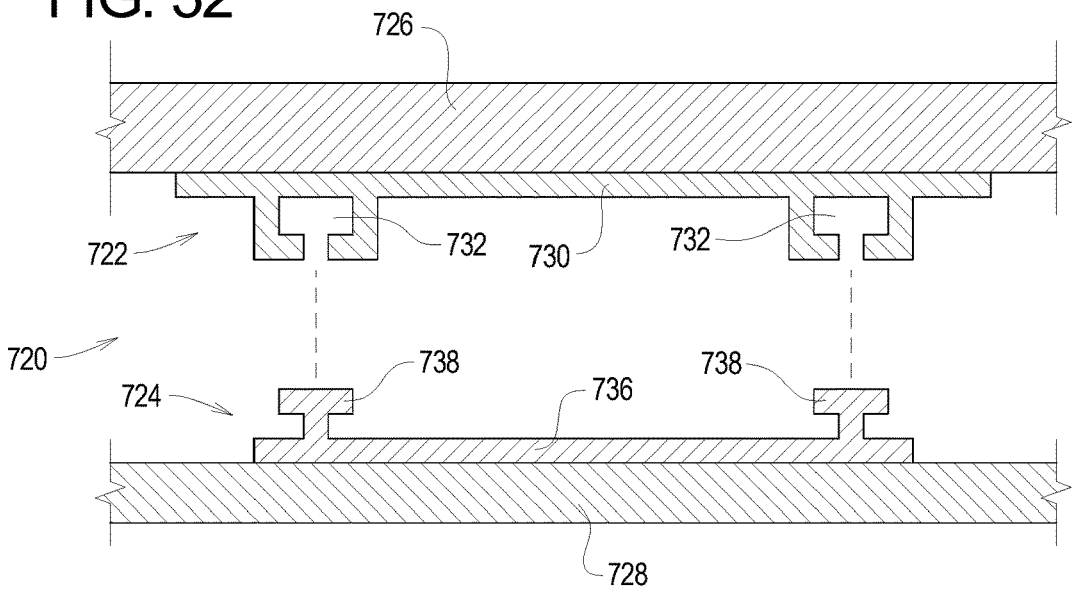
FIG. 32 is a top plan view depicting a fifth example device attachment system of the present invention.
Figure 33:
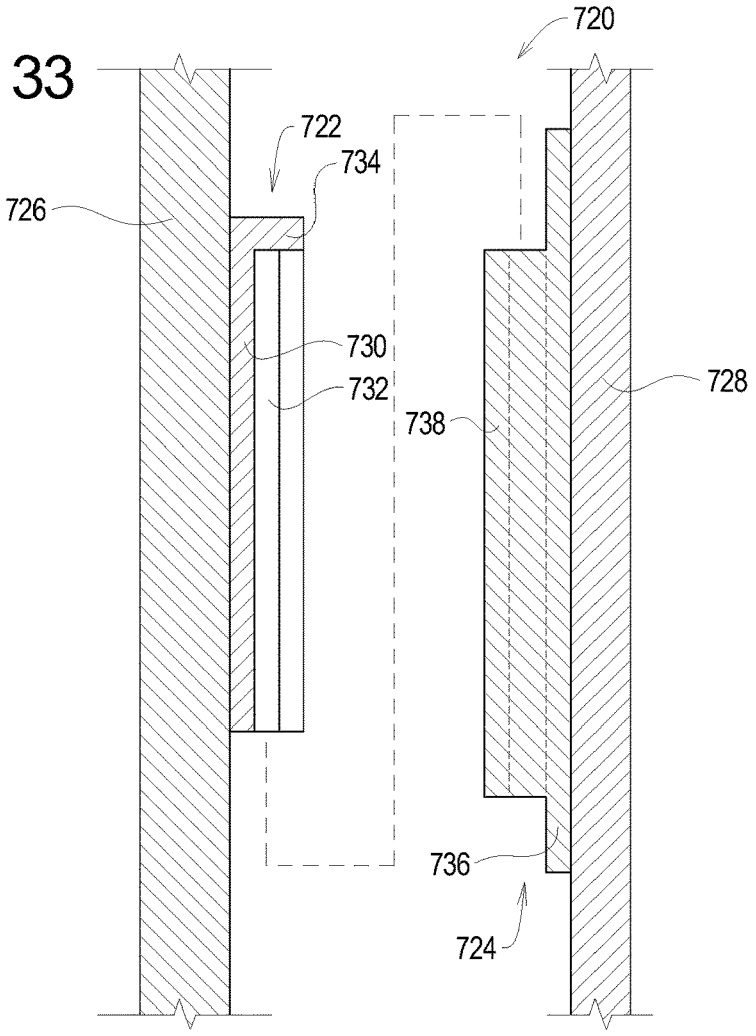
FIG. 33 is a side elevation view of the process of forming the fifth example device attachment system.

FIGS. 30 and 31 illustrate a fourth example device attachment system 650 of the present invention. The fourth example device attachment system 650 comprising a distal portion 652 and a proximal portion 654. The distal portion 652 comprises a plate 660 in which a plurality of slots 662 is formed. The plate 660 is attached to the device 122. The proximal portion 652 is formed by a plurality of hook portions 664 rigidly attached to a structure such as any of the structures recited herein using a structure attachment system such as any of the structure attachment systems described herein. The hook portions 664 engage the slots 662 as shown in FIG. 31 to secure the device 122 relative to the structure.

Figure 34:
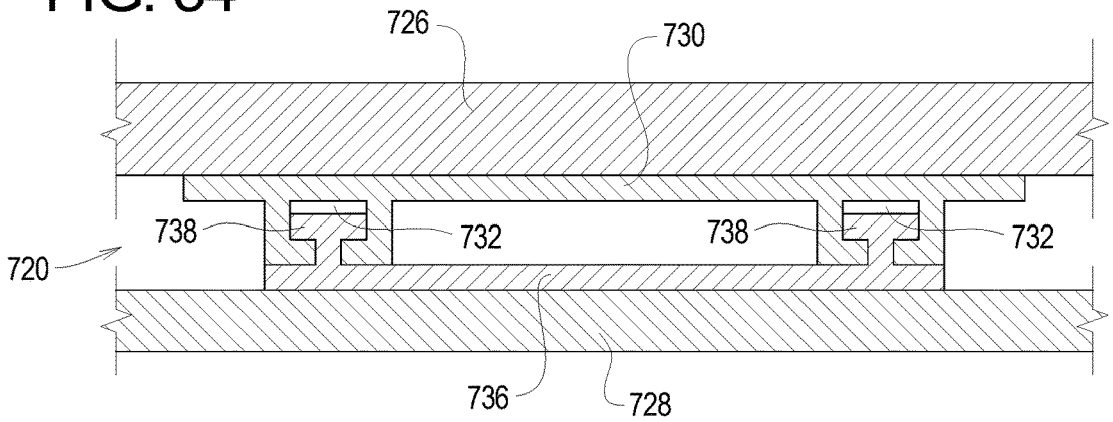
FIG. 34 is a top section view of the fifth example device attachment system.
Figure 35:
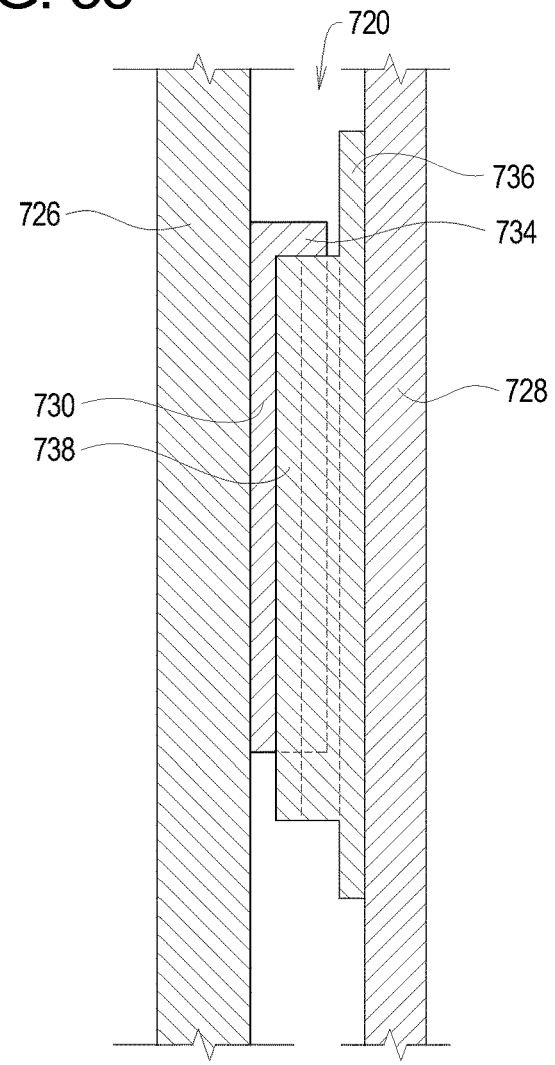
FIG. 35 is a side section view of the fifth example device attachment system.
Figure 36:
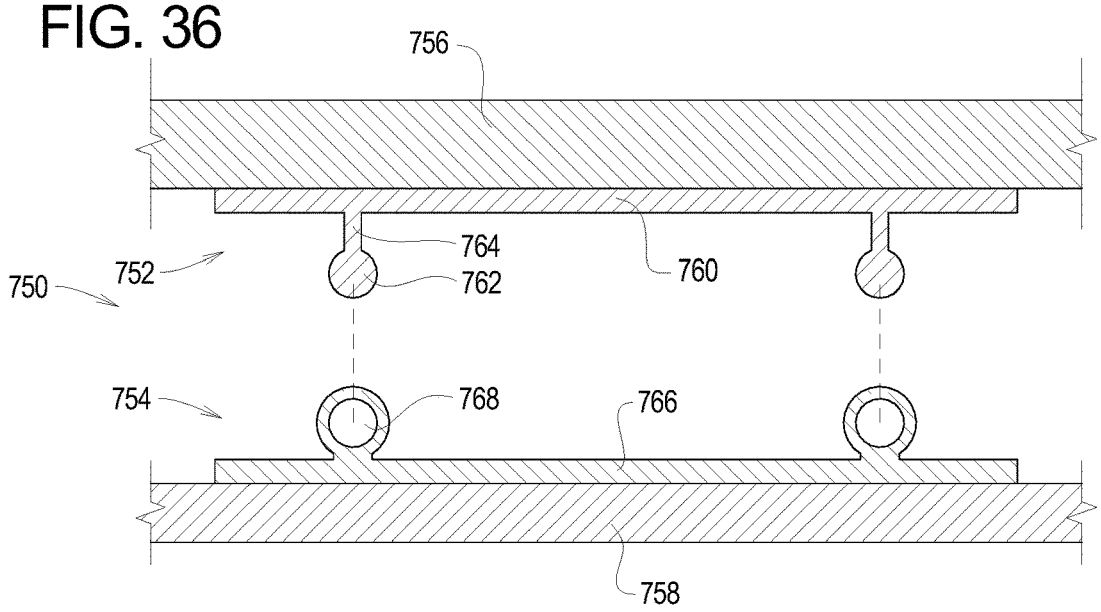
FIG. 36 is a top plan view depicting a sixth example device attachment system of the present invention.
Figure 37:
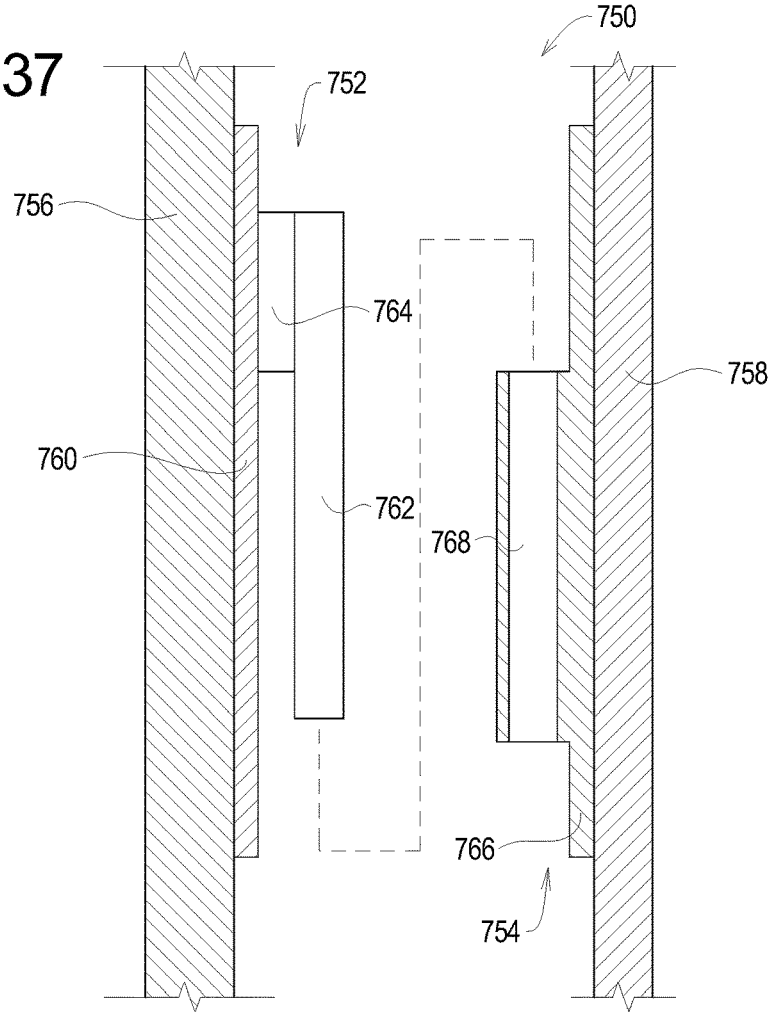
FIG. 37 is a side elevation view of the process of forming the sixth example device attachment system.

FIGS. 32-35 illustrate a fifth example device attachment system 720 of the present invention. The fifth example device attachment system 720 comprising a distal portion 722 and a proximal portion 724. The distal portion 722 is attached to a device 726, and the proximal portion 724 is attached to a structure 728. The distal portion 722 comprises a device plate 730 on which at least one elongate slot 732 is formed. Slot caps 734 are formed on one end of the slot 732. The device plate 730 is attached to the device 726. The proximal portion 724 is formed by a structure plate 736 defining at least one rail 738. The structure plate 736 is secured to the structure 728. The slot(s) 732 are sized and dimensioned to receive the rail(s) 738 as shown in FIGS. 34 and 35 to secure the device 726 relative to the structure 728. When the rails 738 are fully seated in the slots 732, the rails 738 engage the slot caps 734 to prevent further movement of the distal portion 722 relative to the proximal portion 724. The example slot(s) 732 and rail(s) 738 define complimentary T-shaped cross-sectional areas that limit movement of the device 726 relative to the structure 728. The positions of the slots and rails may be switched. Further, a rail cap may be used in place of the slot caps to limit movement of the distal portion 722 and proximal portion 724 relative to each other.

Figure 38:
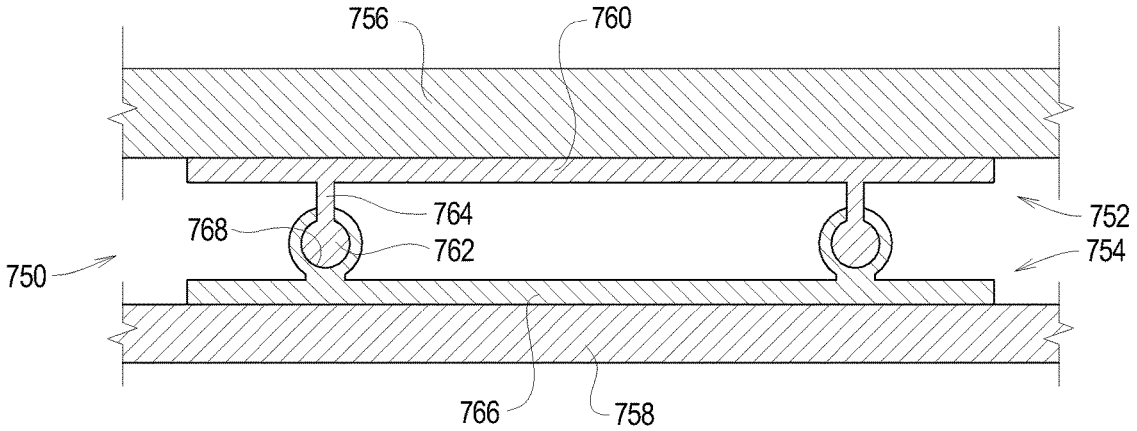
FIG. 38 is a top section view of the sixth example device attachment system.
Figure 39:
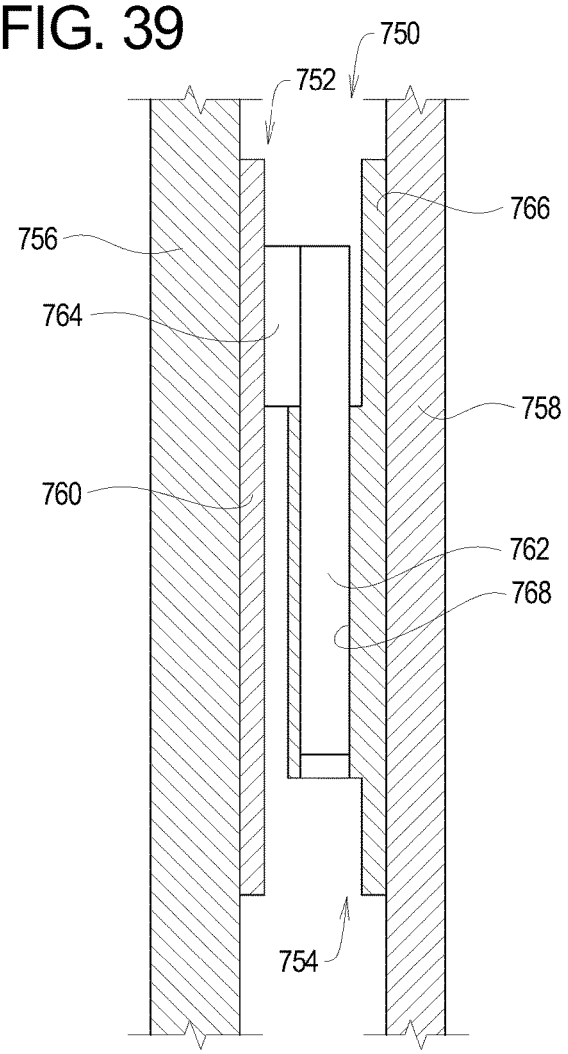
FIG. 39 is a side section view of the sixth example device attachment system.

FIGS. 36-39 illustrate a sixth example device attachment system 750 of the present invention. The sixth example device attachment system 750 comprising a distal portion 752 and a proximal portion 754. The distal portion 752 is attached to a device 756, and the proximal portion 754 is attached to a structure 758. The distal portion 752 comprises a device plate 760 from which a pin 762 is supported by a pin stop 764. The device plate 750 is attached to the device 756. The proximal portion 754 is formed by a structure plate 766 defining at least one socket 768. The structure plate 766 is secured to the structure 758. The socket(s) 768 are sized and dimensioned to receive the pin(s) 762 as shown in FIGS. 38 and 39 to secure the device 756 relative to the structure 758. When the pins 762 are fully seated in the sockets 768, the pin stops 764 engages the upper edges of the sockets 768 to prevent further movement of the distal portion 752 relative to the proximal portion 754. The example pin(s) 762 and socket(s) 768 define complimentary cylindrical cross-sectional areas that limit movement of the device 756 relative to the structure 758. The positions of the pins and sockets may be switched. Further, a socket base at the bottom of the socket may be used in place of the pin stop to limit movement of the distal portions 752 and proximal portion 754 relative to each other.

Figure 40:
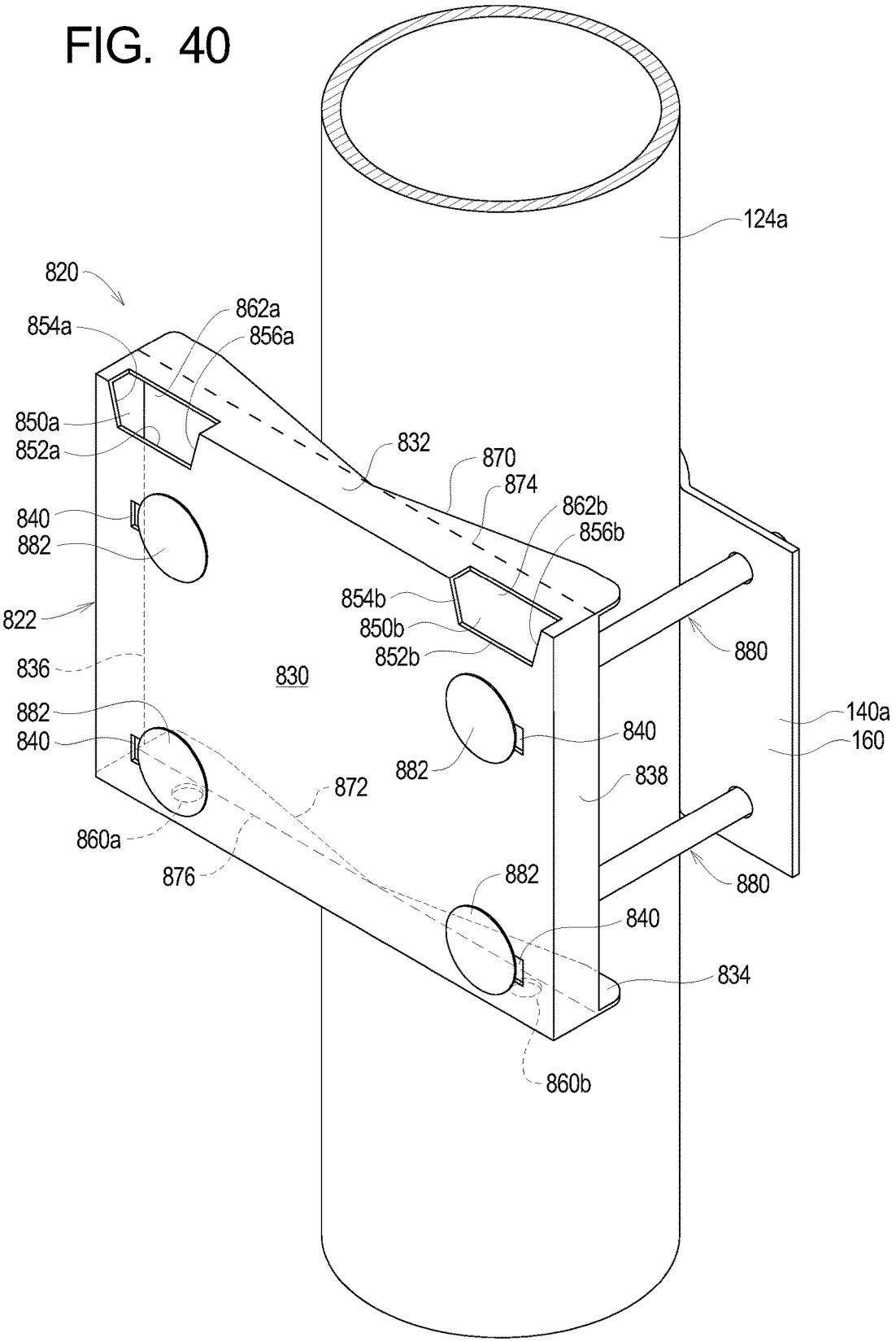
FIG. 40 is a perspective view of another example proximal portion of an example device attachment system that may be used with a mounting system for sports equipment of the present invention.

Turning now to FIG. 40 of the drawing, depicted therein is a proximal portion 820 that may be used as part of the second example device attachment system 130. The example proximal portion 820 comprises a mount 822 defining a main wall 830, a primary brace wall 832, a secondary brace wall 834, and first and second side walls 836 and 838. An array of mounting holes 840 is formed in the main wall 830. One or more support notches 850 are formed in the example primary support flange 832. Each support notch 850 defines a main notch edge 852 and first and second side notch edges 854 and 856. At least one latch opening 860 is formed in the secondary brace wall 834. A clearance notch(es) 862 formed in the primary brace wall 832 is aligned with the support notch(es) 850.

Rear engaging edges 870 and 872 of the primary brace wall 832 and the secondary brace wall 834, respectively, are configured to engage the structures 124*a*, 124*b*, and/or 124*c* to inhibit movement of the proximal portion 820 relative to the structures 124*a*, 124*b*, and/or 124*c* during use. The example engaging edges 870 and 872 comprise angled portions adapted to engage the circular pole structure 124*a*, but these engaging edges 870 and 872 may be straight for the flat wall structure 124*b* or post structure 124*c*. To allow the brace walls 832 and 834 to be modified in situ to accommodate different structure shapes, score lines 874 and 876 may formed in the walls 832 and 834 to allow portions thereof to bent down or up to form flat surfaces perhaps more appropriate for engaging the flat wall structure 124*b* or post structure 124*c*.

The example mount 822 is made of a flat metal sheet cut and bent into the shape depicted in the drawings. The example side walls 836 and 838 of the mount may be welded or otherwise secured to the primary brace wall 832 and secondary brace wall 834 to rigidify the mount 822. The example primary and secondary brace walls 832 and 834 and the example first and second side walls 836 and 838 are bent such that these walls 832-838 are directed towards the structures 124*a*, 124*b*, and 124*c* when in use.

The bolt assemblies 162, lag screws 170, or U-bolt assemblies 180 extend through the mounting holes 840 to detachably attach the mount 822 to the structures 124*a*, 124*b*, and/or 124*c*. Tools may be required to attach the mount 822 to and detach the mount 822 from the pole 124*a*, wall 124*b*, or post 124*c*. Alternatively, a skewer assembly 880 may be used in place of the bolt assembly 162. The example clamp assembly 880 comprises a bolt 882 and a cam assembly 884. The example cam assembly 884 comprises a nut portion 886 and a lever portion 888. The lever portion 888 forms a cam action that allows the bolt 882 to be tightened without the use of tools. The example clamp assembly 880 is or may be similar to quick release clamps used to detachably attach bicycle components (e.g., wheels, seat) relative to a bicycle frame.

With the mount 822 attached to the pole 124*a*, wall 124*b*, or post 124*c*, the primary brace wall 832 and secondary brace wall 834 are substantially horizontal. In this configuration, the main notch edge 852 is substantially horizontal. The side notch edges 854 and 856 are angled with respect to horizontal. The angle between the example side notch edges 854 and 856 and horizontal is less than 90 degrees as shown in FIG. 40. This angle forms guide surfaces that guide the hook portion(s) 250 into the support notch(es) 850 as will be described in further detail below. The clearance notches 862 provide clearance for the hook portion(s) 250 as the hook portion(s) 250 enter the support notch(es) 850 as perhaps best shown in FIG. 41.

With the mount 822 so supported and the at least one frame structure 230 secured to the device 122, the device 122 is then displaced such that the frame structure(s) 230 engage and are supported by the mount 822. The example mount 822 engages the frame structure(s) 230 such that the device 122 is supported at a desired height and orientation relative to the pole 124*a*, wall 124*b*, or post 124*c*. The example mount 822 further engages the frame structures 230 to inhibit lateral and upward movement of the device 122 relative to the mount 822. Further, the latch assembly 222 engages the mount 822 to prevent pivoting and lateral movement of the device relative to the mount 822.

The process of using the second example device attachment system 130 incorporating the proximal portion 820 is similar to that described above with respect to claim 10-13. In particular, the device 122 is attached to the mount 822, and thus to the pole 124*a*, wall 124*b*, and/or post 124*c* to which the mount 822 is attached, using the proximal portion 820 as follows.

Initially, the device 122 is displaced such that the hook portions 250 are adjacent to the main wall 830. The device 122 is then displaced and tilted such that the hook portions 250 extend over the mounting holes 840 formed in the main wall 830. The device 122 is then lowered and pivoted about a pivot axis defined by the closed ends of the hook slots 252 such that the hook slots 242 receive the main wall 830. With the hook portions 250 supported by the main wall 830, the closed ends of the hook slots 252 engage the main notch edges 852. The engagement of the hook portions 250 and the primary brace wall 832 inhibits downward movement of the device 122 relative to the mount 822, while engagement of the hook portions 250 with the main wall 830 inhibits front and back movement of the device 122 relative to the mount 822.

With the hook slots 252 supported by the main wall 830, the hook portions 250 further abut one of the side notch edges 854 and 856 adjacent thereto. Engagement of the hook portions 250 with the side notch edges 854 and 856 inhibits lateral movement of the device 122 relative to the mount 822. Further, the angle of the side notch edges 854 and 856 center the distal portion 150 relative to the proximal portion 820.

With the hook slots 252 supported by the main wall 830, the side flanges 272 engage the main wall 830 and possibly the secondary brace wall 834 to prevent rearward rotation of the device 122 about the pivot axis defined by the closed ends of the hook slots 252.

Additionally, when the hook slots 252 receive the main notch edge 852, the first guide flange 282 is below and adjacent to, or perhaps in contact with, the secondary brace wall 834. In the example shown, four of the stop edges 256 engage the secondary brace wall 834 to inhibit upward movement of the device 122 relative to the mount 822.

Figure 41:
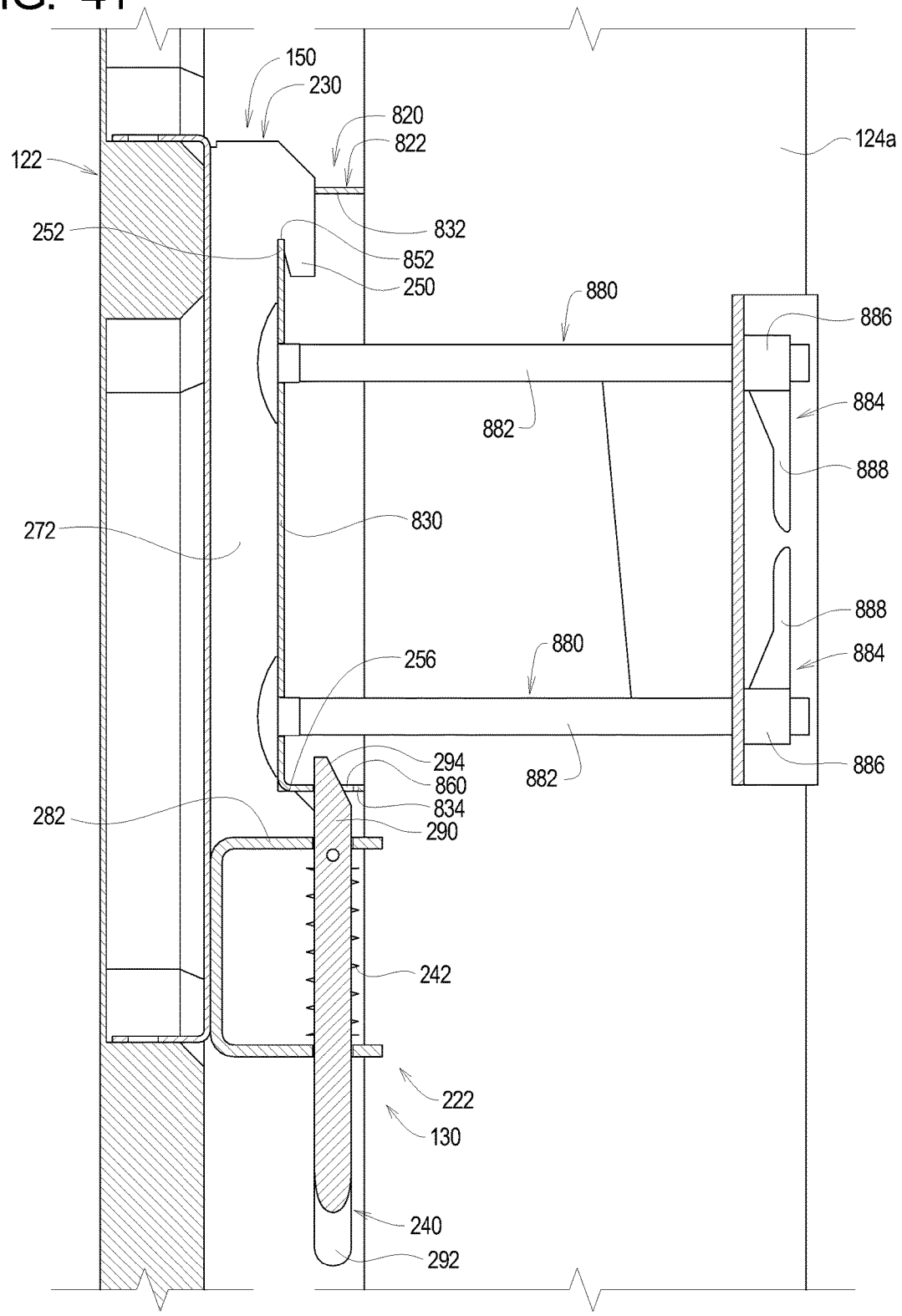
FIG. 41 is a side elevation section view depicting the connection of a distal portion such as the first example distal portion to the example proximal portion depicted in FIG. 40.

When the latch member 240 is in the latched configuration as shown in FIG. 41, the engaging portion(s) 290 thereof extend through the latch openings 860 in the secondary brace wall 834. The latch assembly 222 thus further engages the secondary brace wall 834 to prevent forward rotation of the device 122 about the pivot axis defined by the closed ends of the hook slots 252.

In particular, the example latch assembly 222 is configured to be displaced from the latched position to the unlatched position as the device 122 is lowered and pivoted onto the mount 822. In particular, after the hook portion(s) 250 engage the main notch edge 852, allowing the device 122 to pivot causes the cam surfaces 294 on the engaging portions 290 of the latch member 240 to engage the secondary brace wall 834 such that a force is applied to the latch member 240 against the biasing force of the biasing member(s) 242. The latch member 240 is thus displaced into its unlatched configuration and is held there until the device 122 is substantially parallel to the main wall 830 of the mount 822. At this point, the engaging portion(s) 290 are aligned with the latch opening(s) 860. When the engaging portion(s) 290 are aligned with the latch opening(s) 860, the biasing member(s) 242 return the latch member(s) 240 to the latched configuration. At this point, the second example device attachment system 130 is in its latched configuration.

The process is substantially reversed to remove the device 122 from the mount 822. Initially, the handle portion 292 is grasped, and the latch member 240 is displaced against the force of the biasing member 242 such that the latch member 240 is in the unlatched position. At this point, the second example device attachment system 130 is in its unlatched configuration. The device 122 may be rotated upwardly about the pivot axis and lifted such that the distal portion 150 is disengaged from the proximal portion 820.

In the second example sports mounting system 822, the device 122 may be moved from the pole 124*a*, to the wall 124*b*, or to the post 124*c*. In this case, three of the mounts 822, each with an associated structure attachment systems 140*a*, 140*b*, or 140*c*, are used. With the structure attachment systems 140*a*, 140*b*, and/or 140*c* in place, the example sports mounting system incorporating the proximal portion 820 may thus be easily and quickly moved to various locations depending on the user's needs without the use of tools.

What is claimed is:

1. A mounting system for mounting a plurality of sport devices to a plurality of structures comprising:

a device attachment system comprising a plurality of mounts, and a plurality of frames, where each frame further defines a hook portion; and a structure attachment system for attaching one of the mounts to each of the structures; and a latch assembly comprising a latch member movable between latched and unlatched positions relative to the mount and the frame, and a biasing member for applying a biasing force to the latch member that biases the latch member into the latched position; wherein each of the frames is attached to one of the sport devices;

to allow any of the sport devices to be attached to any of the plurality of structures, each of the mounts is detachably attachable to each of the frames by engaging the hook portion with the mount, and arranging the latch member in the latched position such that the latch member engages both the mount and the frame; and to allow any of the sport devices to be detached from any of the plurality of structures, displacing the latch member into the unlatched position against the biasing force such that the latch member engages only one of the mount and the frame;

disengaging the hook portion from the mount.

2. A mounting system as recited in claim 1, in which the latch member is supported by the frame for movement between the latched and unlatched positions.

3. A mounting system as recited in claim 1, in which the latch member defines a cam surface, where the cam surface engages the mount to displace the latch member from the latched position to the unlatched position when the sport device is attached to the structure.

4. A mounting system as recited in claim 1, in which the latch member defines a cam surface, where the hook portion engages the mount such that the sport device pivots about a pivot axis as the sport device is attached to any of the plurality of structures; and the cam surface engages the mount to displace the latch member from the latched position to the unlatched position as the sport device is pivoted in a downward direction about the pivot axis.

5. A mounting system as recited in claim 1, in which:

the frame defines at least one stop edge; and the mount defines at least one support wall; wherein with the sport device attached to the structure, the at least one stop edge engages the at least one support wall to inhibit upward movement of the sport device relative to the structure.

6. A mounting system for mounting a sport device to a structure comprising:

a device attachment system comprising a frame defining at least one hook portion, where the frame is attached to the sport device, and a mount defining at least one support notch; a structure attachment system for attaching the mount to the structure; and a latch assembly comprising a latch member movable between latched and unlatched positions relative to the mount and the frame, and a biasing member for applying a biasing force to the latch member that biases the latch member into the latched position; wherein to detachably attach the sport device to the structure, the hook portion engages the support notch to prevent downward movement of the frame, displacing the latch member against the biasing force to allow rotation of the frame in a downward direction about a pivot axis relative to the mount, and allowing the biasing force to displace the latch member back into the latched position such that the latch member engages the frame and the mount to prevent rotation of the frame in an upward direction about the pivot axis relative to the mount.

7. A mounting system as recited in claim 6, in which the latch member is supported by the frame for movement between the latched and unlatched positions.

8. A mounting system as recited in claim 6, in which the latch member defines a cam surface, where the cam surface engages the mount to displace the latch member from the latched position to the unlatched position to allow rotation of the frame in a downward direction about a pivot axis relative to the mount.

9. A mounting system as recited in claim 6, in which:

the frame defines at least one stop edge; and the mount defines at least one support wall; wherein with the sport device attached to the structure, the at least one stop edge engages the at least one support wall to inhibit upward movement of the sport device relative to the structure.

10. A mounting system for mounting a sport device to a structure comprising:

a device attachment system comprising a frame defining at least one hook portion, where the frame is attached to the sport device, and a mount defining at least one support notch;

a structure attachment system for attaching the mount to the structure; and a latch assembly supported by the frame, the latch assembly comprising a latch member movable between latched and unlatched positions relative to the frame, and a biasing member for applying a biasing force to the latch member to bias the latch member into the latched position; wherein the hook portion is engaged with the support notch such that the frame is supported for pivoting movement about a pivot axis relative to the mount, as the frame is rotated in a downward direction about the pivot axis relative to the mount, the latch member is displaced into the unlatched position, and when the frame is in a desired orientation relative to the mount, the biasing force forces the latch member into the latched position such that the latch member engages the frame and the mount to prevent pivoting of the frame in an upward direction about the pivot axis relative to the mount.

11. A mounting system as recited in claim 10, in which the latch member defines a cam surface, where the cam surface engages the mount to displace the latch member from the latched position to the unlatched position the frame is rotated in the downward direction about the pivot axis relative to the mount.

12. A mounting system as recited in claim 10, in which:

the frame defines at least one stop edge; and the mount defines at least one support wall; wherein with the sport device attached to the structure, the at least one stop edge engages the at least one support wall to inhibit upward movement of the sport device relative to the structure.

* * * * *